US009328506B2

(12) United States Patent
Gibson

(10) Patent No.: US 9,328,506 B2
(45) Date of Patent: May 3, 2016

(54) CONSTRUCTION PANEL SYSTEM AND METHODS OF ASSEMBLY

(71) Applicant: David Gibson, Mesa, AZ (US)

(72) Inventor: David Gibson, Mesa, AZ (US)

( * ) Notice: Subject to any disclaimer, the term of this patent is extended or adjusted under 35 U.S.C. 154(b) by 0 days.

(21) Appl. No.: 14/024,387

(22) Filed: Sep. 11, 2013

(65) Prior Publication Data

US 2014/0069040 A1 Mar. 13, 2014

Related U.S. Application Data

(60) Provisional application No. 61/699,756, filed on Sep. 11, 2012.

(51) Int. Cl.

| | |
|---|---|
| ***E04C 2/38*** | (2006.01) |
| ***E04B 1/76*** | (2006.01) |
| ***E04C 2/292*** | (2006.01) |
| ***E04C 2/22*** | (2006.01) |
| ***E04B 1/14*** | (2006.01) |
| *E04C 2/52* | (2006.01) |

(52) U.S. Cl.

CPC ... *E04B 1/76* (2013.01); *E04B 1/14* (2013.01); *E04C 2/22* (2013.01); *E04C 2/292* (2013.01); *E04C 2/52* (2013.01)

(58) Field of Classification Search

CPC ..... E04C 2/384; E04C 2/521; E04C 2/22; E04C 2/292; E04B 1/14; E04B 1/76

USPC ..... 52/220.2, 220.3, 220.5

See application file for complete search history.

(56) References Cited

U.S. PATENT DOCUMENTS

| | | | | |
|---|---|---|---|---|
| 3,693,304 | A * | 9/1972 | Shell | 52/204.1 |
| 4,122,203 | A | 10/1978 | Stahl | |
| 4,813,193 | A | 3/1989 | Altizer | |
| 4,817,355 | A | 4/1989 | Tilsley et al. | |
| 5,247,773 | A | 9/1993 | Weir | |
| 5,729,936 | A | 3/1998 | Maxwell | |
| 5,771,645 | A * | 6/1998 | Porter | 52/220.2 |
| 5,867,964 | A | 2/1999 | Perrin | |
| 5,930,960 | A * | 8/1999 | Konnerth | 52/169.5 |
| 6,295,778 | B1 | 10/2001 | Burt | |

(Continued)

FOREIGN PATENT DOCUMENTS

| | | | |
|---|---|---|---|
| FR | 2992670 A1 * | 1/2014 | E04B 1/14 |
| WO | WO2012060863 | 5/2012 | |

OTHER PUBLICATIONS

International Search Report and Written Opinion for PCT Application No. PCT/US2013/59258 issued Feb. 21, 2014.

*Primary Examiner* — Elizabeth A Plummer

(74) *Attorney, Agent, or Firm* — POLSINELLI PC

(57) ABSTRACT

A construction system includes an insulation member. A metal support member is coupled to a side surface of the insulation member. The metal support member is a substantially C-shaped configuration. The metal support member is inserted over an upper side of the wall panel within processed portions of the insulation member to align with the side surface of the insulation member. An extension member portion of the insulation member provides an extension of the insulation member over an exterior side of the wall panel. An exterior sheath is disposed over the extension member portion of the insulation member and over an exterior side of the wall panel. An interior sheath is disposed over an interior side of the wall panel. The exterior sheath and the interior sheath include magnesium oxide.

15 Claims, 20 Drawing Sheets

(56) References Cited

U.S. PATENT DOCUMENTS

| | | | | |
|---|---|---|---|---|
| 6,474,033 | B1 | 11/2002 | Luchini et al. | |
| 6,599,621 | B2 | 7/2003 | Porter | |
| 7,100,342 | B2 | 9/2006 | Holloway | |
| 7,254,925 | B2 | 8/2007 | Stefanutti et al. | |
| 7,797,897 | B2 | 9/2010 | Roth | |
| 8,079,198 | B2 | 12/2011 | Tonyan et al. | |
| 8,176,690 | B2 * | 5/2012 | Stanley | 52/93.2 |
| 8,756,889 | B2 * | 6/2014 | LeBlang | E04B 1/80 52/252 |
| 8,910,439 | B2 * | 12/2014 | Ingjaldsdottir et al. | 52/309.16 |
| 2005/0055982 | A1 * | 3/2005 | Medina | 52/782.1 |
| 2005/0064145 | A1 * | 3/2005 | Hoie et al. | 428/167 |
| 2005/0204699 | A1 * | 9/2005 | Rue | 52/794.1 |
| 2006/0117689 | A1 * | 6/2006 | Onken et al. | 52/309.7 |
| 2006/0191232 | A1 * | 8/2006 | Salazar et al. | 52/606 |
| 2007/0141343 | A1 | 6/2007 | Miller et al. | |
| 2009/0107065 | A1 * | 4/2009 | LeBlang | 52/252 |
| 2009/0126299 | A1 | 5/2009 | Rozhkov | |
| 2009/0205277 | A1 * | 8/2009 | Gibson | 52/309.9 |
| 2010/0011699 | A1 * | 1/2010 | Weimer et al. | 52/745.1 |
| 2011/0067331 | A1 | 3/2011 | Grinsted | |
| 2011/0268916 | A1 * | 11/2011 | Pardue, Jr. | 428/116 |
| 2011/0296778 | A1 * | 12/2011 | Collins et al. | 52/220.1 |
| 2012/0216476 | A1 * | 8/2012 | Naidoo | 52/309.4 |
| 2014/0033627 | A1 * | 2/2014 | Stephens et al. | 52/204.5 |

* cited by examiner

CONSTRUCTION PANEL SYSTEM AND METHODS OF ASSEMBLY

CROSS-REFERENCE TO RELATED APPLICATIONS

The present application claims priority to U.S. Provisional Application No. 61/699,756 filed on Sep. 11, 2012, the entire contents and disclosure of which are herein incorporated by reference.

FIELD

This disclosure relates generally to the field of prefabricated structural insulated panel systems, and in particular to a construction system that includes generally light-gauge metal structural components, relatively rigid foam insulation, sheathing materials, thermal breaks, utility chases, and is capable of being assembled into a usable structure or dwelling by relatively unskilled labor.

BACKGROUND

Many conventional panelized systems may provide a structural core and insulation, but fail to include exterior and/or interior finished skins, which results in additional field labor, cost, and time. Moreover, many conventional systems are fabricated from materials such as wood and/or paper products that are not necessarily durable or resistant to aging and decay. For example, many structural insulated panel systems that are at least partially fabricated from wood products are subject to the dangers of fire, termites, dry rot, mold, and/or other forms of environmentally caused decay. In addition, some conventional prefabricated construction panel systems lack the physical integrity and strength to withstand hurricane-force winds and earthquakes and further lack sufficient air and vapor barriers such that the occupants are not sufficiently protected from the elements. Moreover, several systems fail to provide a thermal break to reduce and/or eliminate condensation and thermal transfer through the aforementioned conventional panels. As such, there is a demonstrated need for construction materials that employ materials that are resistant to many environmental hazards and include finished interior and/or exterior skins or unsheathed panels to provide a complete prefabricated finished panel system that can be rapidly assembled by unskilled labor.

Although some organizations are attempting to develop technologies in the international markets, the demand has outpaced the supply. As such, there is an opportunity for the efficiency of mass production of standardized components that are employable in housing and commercial products. More particularly, with regards to shelter, the provision of mass housing can be more easily provided through mass production and standardization. This standardization should be responsive to the demands and diverse living conditions of the world populations and environments, as well as change and growth. As such, there is a need for affordable housing on a worldwide scale that can be provided using efficiencies in construction, time, shipping, and labor. In particular, there is a need to solve the housing crisis by combining mass produced repetitive elements designed for shipping efficiency and rapid, on-site assembly using a minimal number of crew members with relatively unskilled local labor.

In addition, the present trend in mass-produced housing is to integrate and systemize the construction process. Some common conventional approaches to achieve these goals include using jigs, pre-cut units, panelized walls, modular units, and mobile housing. Although these conventional approaches and associated technologies are being developed and internationally marketed, as mentioned above, these exhibit significant shortcomings that fail to keep up with global demand.

Some conventional systems may also employ magnesium oxide as a replacement for certain materials. For example, the use of magnesium oxide boards (MgO) as a replacement for OSB or plywood sheathing on structural insulated panels is not structurally sound in that MgO is more brittle than OSB or plywood and can crack, which leads to the a loss of the structural integrity of the panels. In addition there are no conventional systems on the market that enable conventional field assembly stick by stick for the framing, separate installation of the insulation (sound insulation where required) and installation of the gypsum board on both sides.

SUMMARY

Some embodiments provide a construction system that includes a plurality of panels. Moreover, at least some of the plurality of panels may include an upper side, a lower side, an insulation member, and at least one support member that can be coupled to the insulation member. In some aspects, the support member may be coupled to the insulation member such that the support member extends from the upper side to the lower side of the panel. In some embodiments, the construction system may also include a plurality of engagement elements that are configured to engage at least some of the panels to assemble the panels into at least a portion of a structure.

Some embodiments provide a wall panel that includes a first lateral side that can oppose a second lateral side and an upper side that can vertically oppose a lower side. The wall panel can also include an insulation member that can be coupled to at least one support member. In some aspects, the support member can exhibit a substantially C-shaped configuration. Moreover, the support member can be coupled to the insulation member such that the support member extends from a position substantially adjacent to the upper side of the wall panel to a position that is substantially adjacent to the lower side of the wall panel. In some embodiments, the wall panel can also include at least one horizontal chase and at least one vertical chase that can be defined by the insulation member.

In some embodiments, the construction system includes at least one wall panel that includes an upper side, a lower side, and an insulation member that can be coupled to a support member. Moreover, the support member can include a substantially C-shaped configuration. In addition, the support member can be coupled to the insulation member such that the support member extends from a position substantially adjacent to the upper side of the wall panel to a position that is substantially adjacent to the lower side of the wall panel. In some embodiments, the construction system can include at least one roof panel and at least one clip that is capable of being configured and arranged to couple together the wall panel and the roof panel. Furthermore, the construction system can also include at least one floor panel and at least one sole plate that is configured and arranged to couple together the wall panel and the floor panel.

In addition, some embodiments of the system may include one or more panels with or without interior and/or exterior sheaths. In particular, the selection of interior and exterior sheaths may be at least partially based on the overall weight of the panel. For example, for a contractor without a crane to assist in lifting the panels, the sheathless panels will be more appropriate, while for the contractor with the crane to assist, the convenience of the fully prefabricated panel can save more time and money.

Additional objectives, advantages and novel features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings. The headings used in the figures should not be interpreted to limit the scope of the claims.

DETAILED DESCRIPTION

Figure 1:
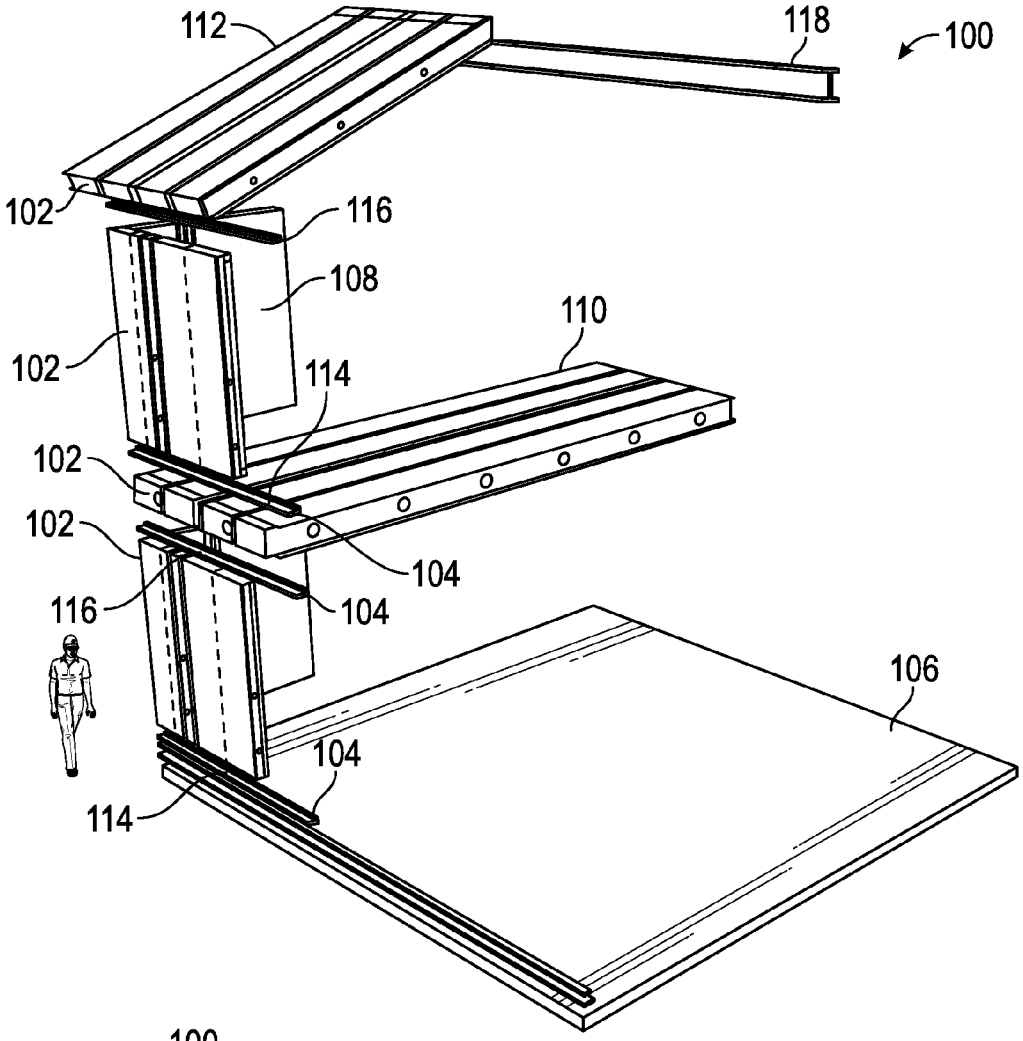
FIG. 1 is an exploded perspective view of an embodiment of a construction system.

Referring to the drawings, embodiments of a construction system are illustrated and generally indicated as 100, 200 and 300 in FIGS. 1-36. Some embodiments of the construction system 100, 200 and 300 can provide a substantially complete system that can be based upon prefabricated (e.g., factory built) components. The construction system 100, 200 and 300 can employ generally standardized components and subcomponents that can be adaptable to meet diverse international and multi-functional design criteria. For example, some of the components of the construction system 100, 200 and 300 can be erected in an individual manner using generally standardized panel widths (e.g., two and four feet, as described below) and/or using larger panel widths (e.g., a width of an entire section of a structure, such as a wall). Moreover, some components of the construction system 100, 200 and 300 can be provided to the individual assembling a structure in a state that is complete or nearly complete such that only limited additional "touching-up" is necessary (e.g., painting or the application of an insulating finishing system to the components). In addition, the prefabrication of some or all of the components of the construction system 100, 200 and 300 within a controlled factory environment can provide consistently high quality engineered materials.

Furthermore, although some aspects of the construction system 100, 200 and 300 can be standardized to meet building criteria, the overall design can be generally flexible to meet localized requirements. For example, different climates and/or cultures may dictate different constituent materials. As such, some or all of the components of the construction system 100, 200 and 300 can be designed to accommodate various climatic conditions, including extreme heat, extreme cold, arid environments, humid environments, and environments with multiple freeze-thaw cycles. Moreover, some or all of the components of the construction system 100, 200 and 300 can be resistant and/or substantially or completely impervious to fire, water, rust, hurricane-force winds, earthquakes, mold, termites, other pests, high salinity environments, and/or chlorine. Accordingly, the components of the construction system 100, 200 and 300 can be considered very durable and tolerant of climatic variances.

Referring now to FIG. 1, the construction system, designated 100 may include a plurality of panels 102 and a plurality of engagement elements 104. For example, the plurality of panels 102 and the plurality of engagement elements 104 can be employed by individuals assembling a structure (e.g., a dwelling, residence, commercial structure, government structure, civic structure, etc.) to provide structural elements of the structure, such as walls, floors, ceilings, roofs, window and door openings, etc. In some aspects, as described in greater detail below, the plurality of panels 102 and the plurality of engagement elements 104 can be at least partially engaged and/or coupled together using conventional coupling techniques and/or conventional coupling apparatuses to form the structural elements of the structure.

In some embodiments, the plurality of panels 102 can include at least one wall panel 108, at least one floor panel 110, and at least one roof panel 112. In some aspects, the plurality of panels 102 can include pluralities of wall panels 108, floor panels 110, and/or roof panels 112. Similarly, in some aspects, the plurality of engagement elements 104 can include one or more sole plates 114 and one or more top plates 116.

Moreover, in some aspects, the plurality of panels 102, the plurality of engagement elements 104, and/or some other elements of the construction system 100 can be at least partially supported by a slab 106 (e.g., a concrete slab or position over basement panels (not shown) or a crawl space raised footings (not shown) fabricated from similar materials) such that the slab 106 forms the basal structural support for the structure. For example, after positioning of the slab 106, the individuals assembling the structure can couple one or more sole plates 114 to an area substantially adjacent to an edge of the slab 106. In some aspects, one or more sole plates 114 can be positioned near some or all of the edges of the slab 106. As such, the sole plates 114 can function to secure one or more of the plurality of panels 102 to the slab 106. After positioning of the sole plates 114, one or more wall panels 108 can be coupled to the sole plates 114 to provide walls for the structure that are supported by the slab 106. Thereafter, one or more top plates 116 can be coupled to the wall panels 108 (e.g., at an upper portion of the wall panels 108) to provide a manner of coupling the wall panels 108 to one or more of the floor panels 110. In some aspects, one or more additional sole plates 114 can be coupled to the floor panels 110 to provide a manner of coupling one or more additional wall panels 108 to growing structure. As such, additional floors of the growing structure can be added in a similar manner until the structure reaches the desired size. Upon positioning of the wall panels 108 of an uppermost floor of the structure, one or more additional top plates 116 can be engaged to the wall panels 108 and, thereafter, one or more roof panels 112 can be coupled to the top plates 116 that have been coupled to the uppermost wall panels 108. At the same time as coupling to the top plates 116, prior to coupling to the top plates 116, and/or after coupling to the top plates 116, the roof panels 112 may also be coupled to a ridge beam 118, which can further provide structural support to the structure. In other embodiments, the plurality of panels 102, the plurality of engagement elements 104, and/or some other elements of the construction system 100 can be at least partially supported by other non-slab structures (not shown).

Some or all of the plurality of panels 102 can include multiple features. Moreover, although the following discussion details some of the features associated with the wall panels 108, some or all of the following features can equally apply to the floor panels 110, the roof panels 112, and/or other constituents of the construction system 100. In some aspects, at least some of the wall panels 108 can be provided with different configurations. For example, the wall panels 108 can be manufactured such that some or all of the wall panels 108 exhibit the same or a substantially similar width. Specifically, in some embodiments, some or all of the wall panels 108 can define an approximately two-foot width (as shown in FIGS. 2-11) or an approximately four-foot width (as shown in FIGS. 12-27). As such, the wall panels 108 can provide uniformity across the construction process of the structure so that repeating elements disposed within the wall panels 108 can substantially align across the different wall panels 108 and different levels or floors of the structure. In other embodiments, the wall panels 108 can be provided with any other width (e.g., one foot, three feet, five feet, six feet, seven feet, etc.) to suit manufacturer, builder, or end user needs. Moreover, as previously mentioned, in some embodiments, the construction system 100 can be provided with greater width wall panels 108 (e.g., wall panels 108 with a width of an entire wall). In addition, some or all of the wall panels 108 or others of the plurality of panels 102 can exhibit varying lengths (e.g., eight feet, nine feet, twelve feet, twenty feet, thirty feet, forty feet, etc.).

Figure 2:
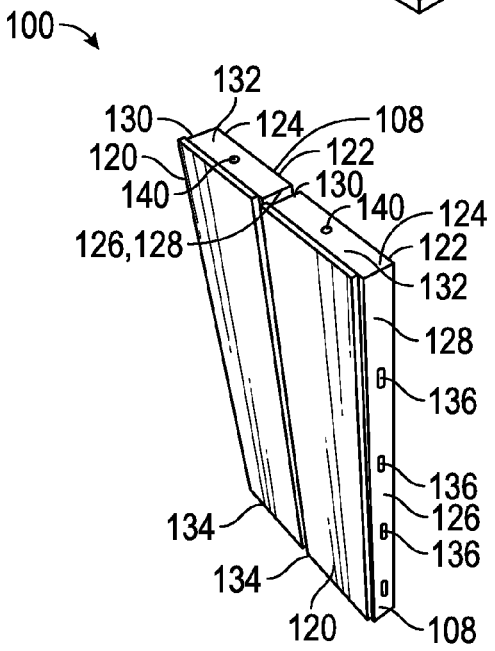
FIG. 2 is a front perspective view of two wall panels of the construction system.
Figure 3:
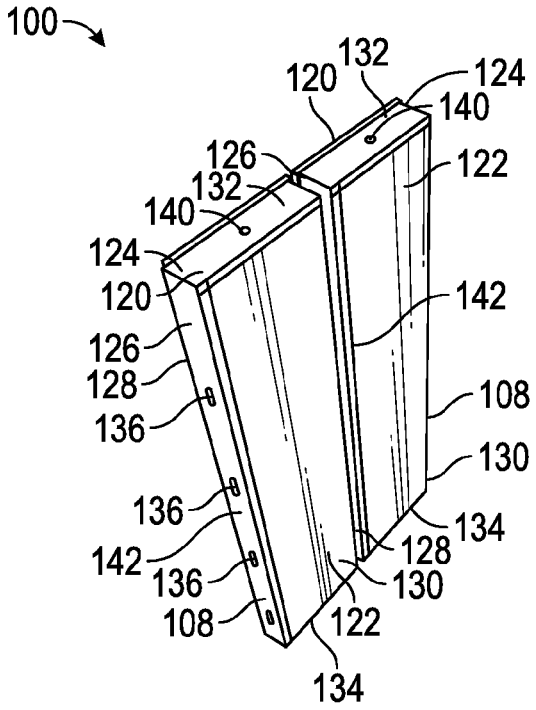
FIG. 3 is a rear perspective view of the wall panels of FIG. 2.
Figure 4:
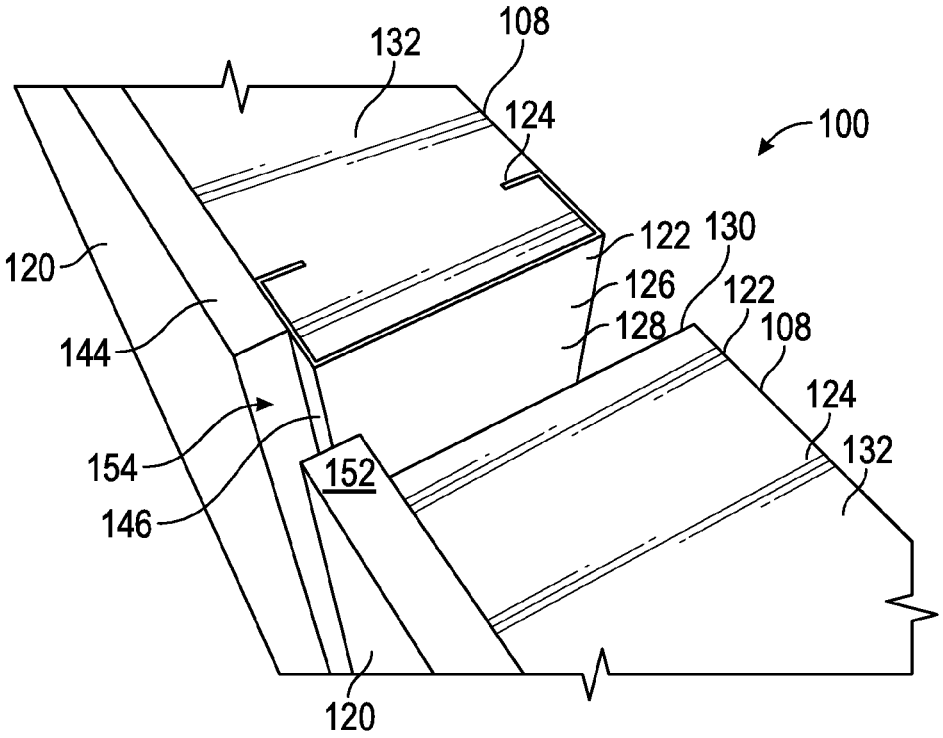
FIG. 4 is a magnified front perspective view of the wall panels of FIG. 2.
Figure 5:
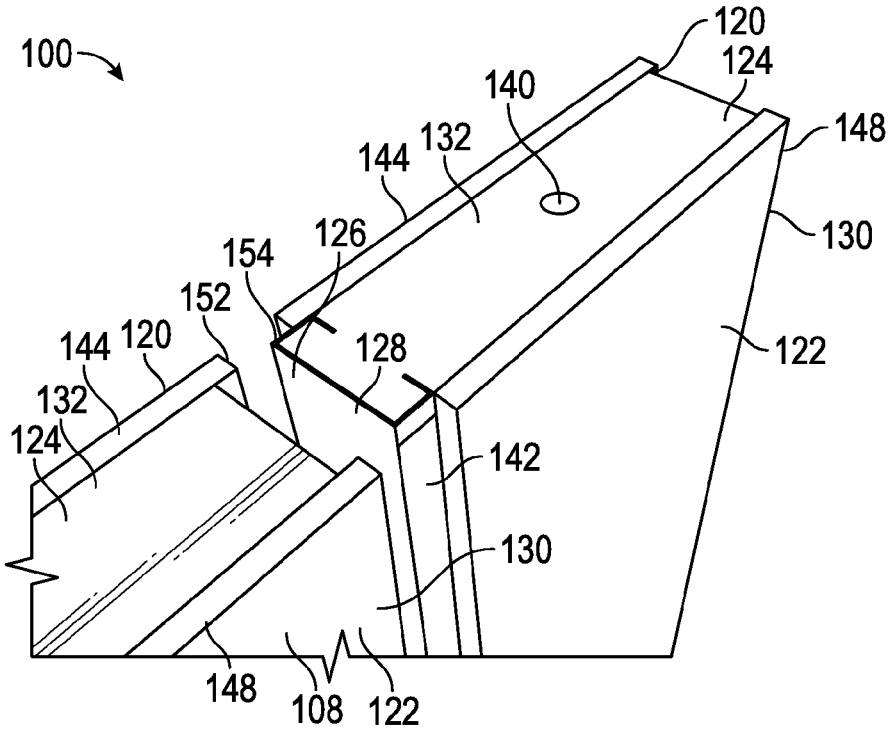
FIG. 5 is a magnified rear perspective view of the wall panels of FIG. 2.

In some embodiments, some or all of the wall panels 108 may include an exterior side 120, an interior side 122, an insulation member 124, at least one support member 126, a first lateral side 128, and a second lateral side 130, an upper side 132, and a lower side 134, as shown in FIGS. 2-5 (lower side 134 now shown in FIGS. 4 and 5). In particular, the wall panels 108 can be coupled together with respect to the other elements of the construction system 100 such that the exterior side 120 is finally positioned facing the outer environment or exterior of the structure and the interior side 122 is finally positioned facing the interior of the structure (e.g., the dwelling or living space). Moreover, in some aspects, some or all of the wall panels 108 can be configured in a generally rectangular-like configuration such that the first and second lateral sides 128, 130 are generally parallel in orientation to each other and positioned in a generally vertical position after installation. Similarly, the upper and lower sides 132, 134 can also be positioned generally parallel to each other, perpendicular with respect to the first and second lateral sides 128, 130, and in a generally horizontal position after installation. As described in greater detail below, the first and second lateral sides 128, 130 of some or all of the wall panels 108 can be used to engage together immediately adjacent wall panels 108 and the upper and lower sides 132, 134 of some or all of the wall panels 108 can at least partially provide a mechanism for engaging the sole and top plates 114, 116, respectively.

In some embodiments, some or all of the wall panels 108 also include the insulation member 124 and at least one support member 126. In particular, the insulation member 124 can occupy a significant portion of a depth of some or all of the wall panels 108. Specifically, the insulation member 124 can be extended a depth extending from a point substantially adjacent to the exterior side 120 to the interior side 122 to provide insulative functionality to the wall panels 108. In some embodiments, the insulation member 124 can be manufactured from a foam material (e.g., polyurethane foam, expanded polystyrene foam, XPS foam, or other rigid insulating materials) to provide insulation to individuals within the structure from environmental factors (e.g., heat, cold, precipitation, sound, humidity, aridity, etc.). In some embodiments, the insulation member 124 can be fabricated from a rigid foam material so that the insulation member 124 is capable of providing some level of structural support, in addition to any insulative functionalities (including thermal, sound, and air filtration). In other embodiments, the insulation member 124 can be fabricated from other conventional materials that can provide suitable insulation for the structure.

In some embodiments, the at least one support member 126 can be engaged to portions of the wall panels 108. In some aspects and as described in greater detail below, some configurations of the wall panels 108 can include one support member 126 and other configurations of the wall panels 108 may include more than one support member 126. For example, the support members 126 may be configured as studs that can provide structural support for the structure. In particular, the support members 126 may be configured as metal studs to provide sufficient support for the structure. In addition, in some aspects, the support members 126 may be fabricated from other materials, such as wood or polymers. Moreover, in some embodiments, the support members 126 may be configured as joists (e.g., metal joists), depending on which of the plurality of panels 102 is being used (e.g., joists for the roof or floor panels 110, 112 and studs for the wall panels 108).

The support members 126 may be provided in a plurality of configurations. For example, at least some of the support members 126 employed by the construction system 100 may be configured as "C" studs (i.e., shaped like the letter C) (as shown in FIGS. 2-5). In other embodiments, the support members 126 may be configured in any other manner, such as "U," "T," "L," "W," and/or "I" studs or joists to provide the necessary support for the structure (not shown). Moreover, in some aspects, the support members 126 can be configured such that the length of the support members 126 is equal to or substantially similar to the length of the wall panels 108 and/or the insulation members 124. In other words, the support members 126 can extend from a position generally immediately adjacent to the upper side 132 to a position generally immediately adjacent to the lower side 134.

Figure 10:
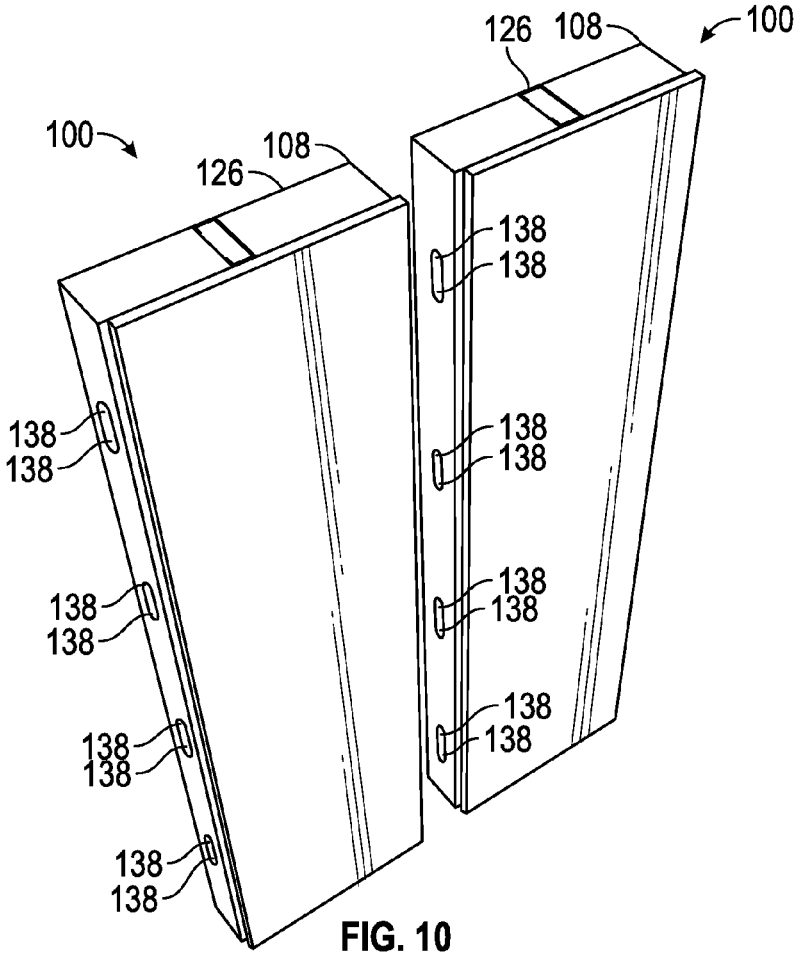
FIG. 10 is a rear perspective view of an embodiment of two wall panels.
Figure 11:
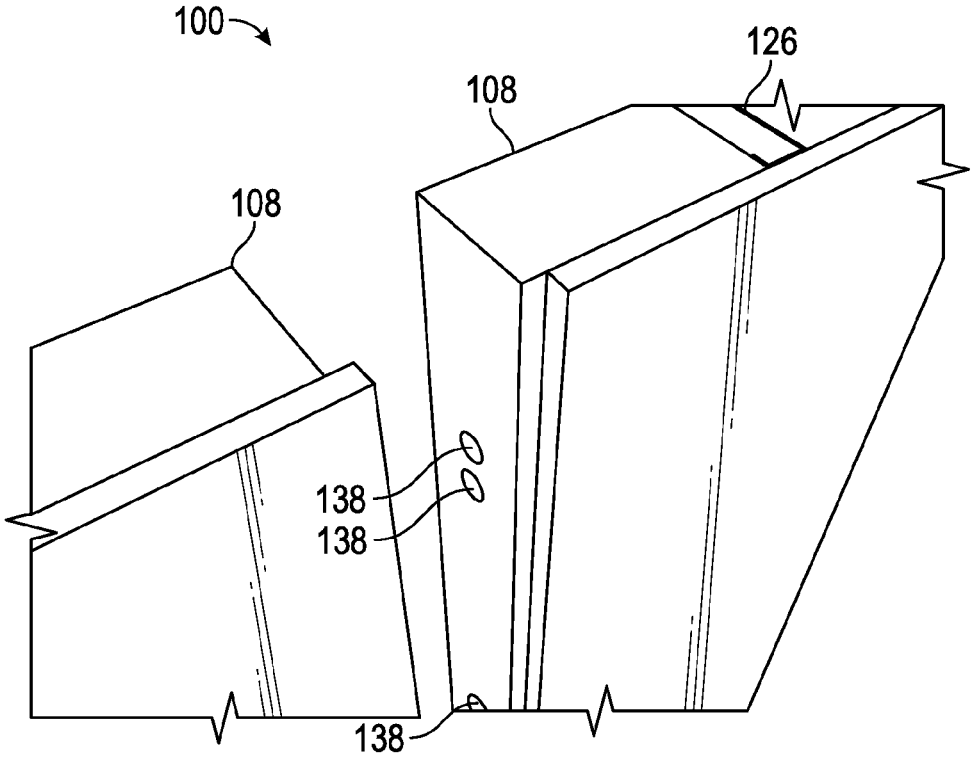
FIG. 11 is a magnified rear perspective view of the two wall panels of FIG. 10.

In some embodiments, at least some of the support members 126 can be coupled to a portion of the wall panels 108. A support member 126 may be coupled to at least some of the wall panels 108 at one or both of the first and second lateral sides 128, 130. For example, a first support member 126 can be coupled to the first lateral side 128 of a first wall panel 108 and another support member 126 can be coupled to the first lateral side 128 of a second wall panel 108 such that when the wall panels 108 are assembled, the support members 126 are disposed at regular positions throughout the structure (e.g., every two feet). Moreover, because of the generally uniform nature of all of the constituent components of the construction system 100, when fully assembled, the support members 126 should align at a regular interval (e.g., every two feet) to provide the structure with structural integrity. For example, the support members 126, being positioned approximately at two-foot intervals throughout the length and width of the structure, when aligned over the height of the structure, can provide load-bearing support for the structure as a whole. Furthermore, as shown in FIGS. 10 and 11 and explained in greater detail below, the support members 126 can be positioned in other locations along the width of the wall panels 108 (e.g., in a generally central location)

Figure 16:
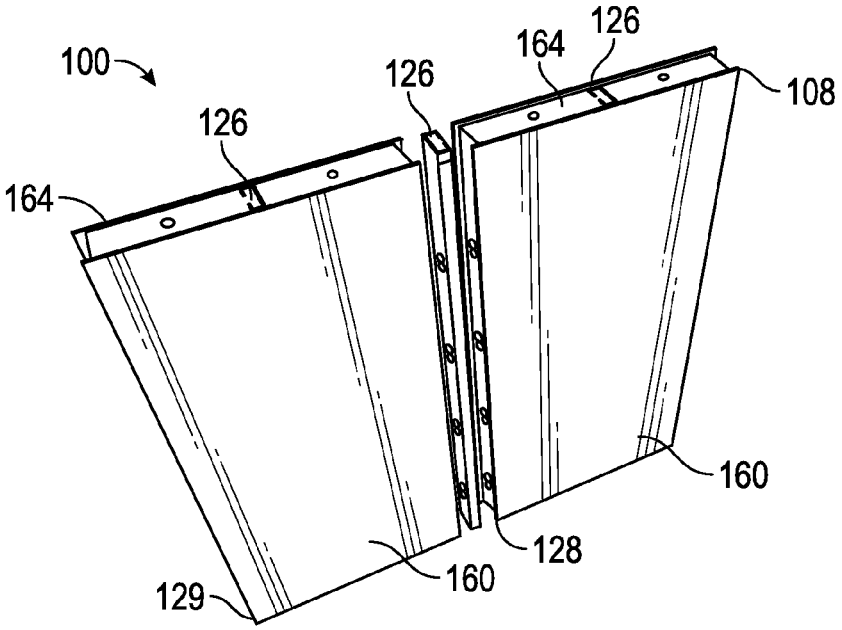
FIG. 16 is a rear perspective view of an embodiment of two wall panels.

In some embodiments, at least some of the support members 126 can engage the insulation members 124. As best viewed in FIG. 4, at least some of the support members 126 can be directly coupled to the insulation member 124. For example, after fabrication, the insulation member 124 can be processed (e.g., cut) such that the portions of the support member 126 can be inserted into the insulation member 124 and remain engaged during the building process. In some embodiments, an additive, such as an adhesive or coupling member (e.g., a nail, screw, etc.) can be used to ensure that the insulation member 124 and the support member 126 remain coupled together. In other embodiments, the friction associated with the interaction of the insulation member 124 and the support member 126 will be sufficient to ensure that the two elements remain engaged. In some embodiments, other support members 126 may also be used with the construction system 100 that are not engaged to the wall panels 108 prior to assembly (as shown in FIG. 16).

Referring back to FIGS. 2 and 3, at least some of the support members 126 can define one or more apertures 136. For example, each of the support members 126 can define four apertures 136 in generally parallel positions and distributed over a height of the support members 126. As such, the apertures 136 can be located to enable the positioning of utility conduits (e.g., water lines, gas lines, electrical wires, etc.) through the wall panels 108 before, during, or after assembly of the structure. In particular, as best viewed in FIGS. 10, 11, and 19, at least some of the wall panels 108 can define a plurality of horizontal chases 138 that extend from the first lateral side 128 to the second lateral side 130. As such, when the support members 126 are engaged to the insulation member 124, the apertures 136 can substantially or completely align with the plurality of horizontal chases 138 to ensure that the support members 126 do not block the horizontal chases 138. Moreover, when fully assembled, the apertures 136 and the plurality of horizontal chases 138 along any given wall of the structure can align to form the utility conduits, as mentioned above.

In addition, in some aspects, the plurality of horizontal chases 138 can be positioned such that more than one of the plurality of horizontal chases 138 aligns with one of the apertures 136. For example, some or all of the wall panels 108 can be configured such that two horizontal chases 138 are generally adjacent so that there are two horizontal chases 138 for each aperture 136 of the support member 126. In other embodiments, the ratio of horizontal chases 138 to apertures 136 can be greater or lesser than two to one or can vary per wall panel 108.

In some aspects, at least some of the wall panels 108 can include at least one vertical chase 140, in addition to the plurality of horizontal chases 138. Referring back to FIGS. 2-5, in some embodiments, some or all of the wall panels 108 can include one or more vertical chases 140 that are generally centrally located, with respect to the width of the wall panel 108. Moreover, the vertical chase 140 can extend the entire length of the wall panel (i.e., from the upper side 132 to the lower side 134) to similarly provide for utility conduits so that utility lines can extend up and down the different floors of the structure. In particular, after assembly, the vertical chases 140 disposed in the wall panels 108 can align with other chases in others of the plurality of panels 102 to provide utility conduits throughout the structure. In other embodiments, the wall panels 108 can include more than one vertical chase 140 and/or the vertical chase 140 can be located in other positions (i.e., positions that are not generally centrally located with respect to the width of the wall panel 108).

In some embodiments, a gasket tape 142 can be applied to at least a portion of the wall panels 108. For example, as illustrated in FIGS. 2, 3, and 5, the gasket tape 142 (not shown in FIG. 2) can be applied to a portion of one or more of the support members 126 that faces the interior and exterior of the structure. In particular, after assembly of the structure, the gasket tape 142 can function as both a thermal and sound break to reduce the transmission of thermal energy and sound through the wall panels 108.

Referring again to FIGS. 2-5, one or more of the wall panels 108 may also include an extension member 144. For example, each of the wall panels 108 may have an extension member 144 coupled to the exterior side 120 of the wall panels 108. In some aspects, the extension member 144 may be configured as an additional portion of the same or a similar material as the insulation member 124. As such, the extension member 144 may provide an additional layer of insulation and structural support for the structure. For example, the extension member 144 may be configured as an approximately one inch foam extension to the wall panels 108 that provides additional insulation for the structure.

Moreover, the extension member 144 may be coupled (e.g., via an adhesive or coupling device such as a nail, screw, bolt, etc.) to the exterior side 120 before, after, or during fabrication of the wall panels 108. As best viewed in FIG. 4, the extension member 144 can be configured such that it defines an extension recess 146 along a width of the extension member 144. Moreover, the extension member 144 can be coupled to the wall panels 108 such that the extension recess 146 is positioned generally adjacent to the upper side 132 of each of the wall panels 108.

In addition, the interior side 122 of at least some of the wall panels 108 may define a plate recess 148. Referring to FIGS. 3 and 5, the plate recess 148 may extend from the first lateral side 128 to the second lateral side 130 of some or all of the wall panels 108 and can be configured and arranged to engage at least a portion of the top plate 116 to aid in assembling the structure.

Figure 6:
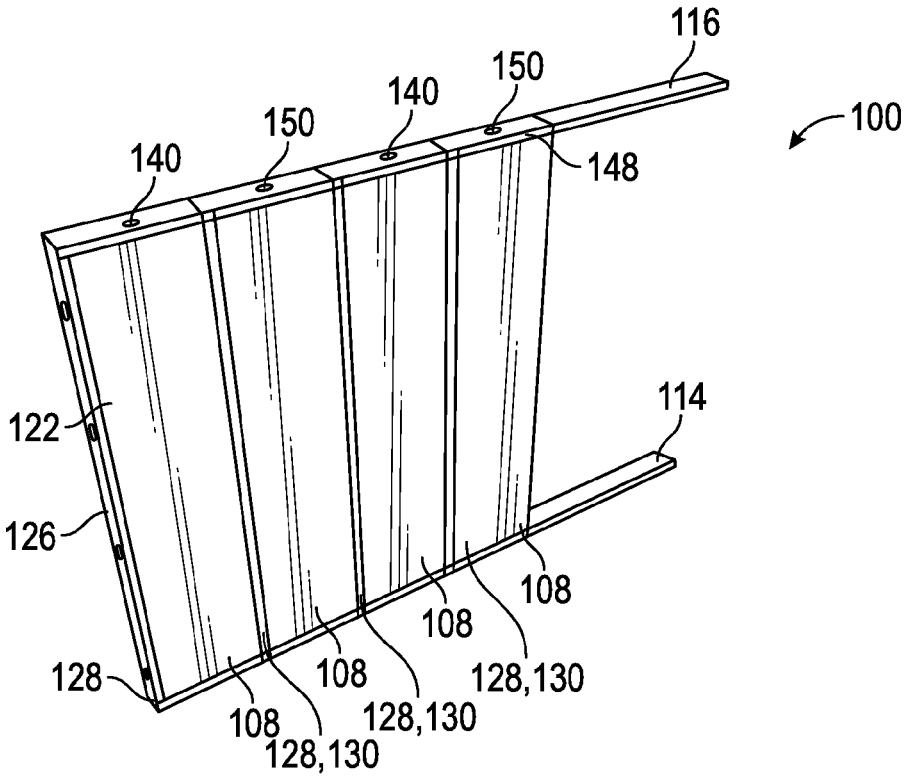
FIG. 6 is a rear perspective view of a plurality of wall panels coupled together with a sole plate and a top plate.
Figure 7:
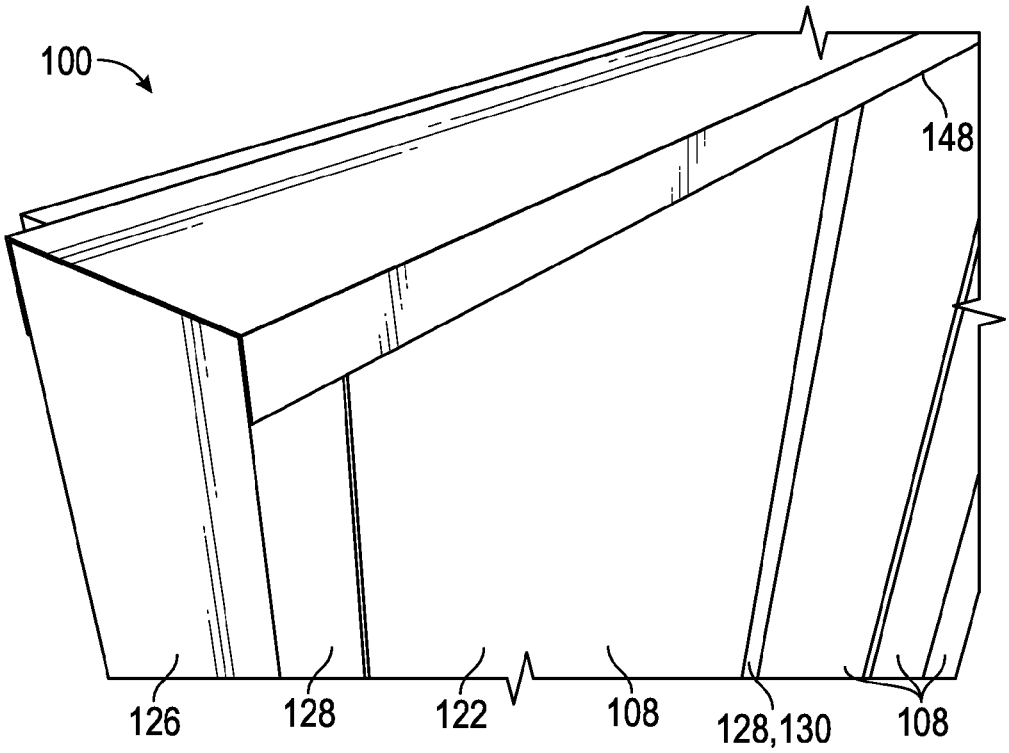
FIG. 7 is a magnified perspective view of the plurality of wall panels of FIG. 6.
Figure 8:
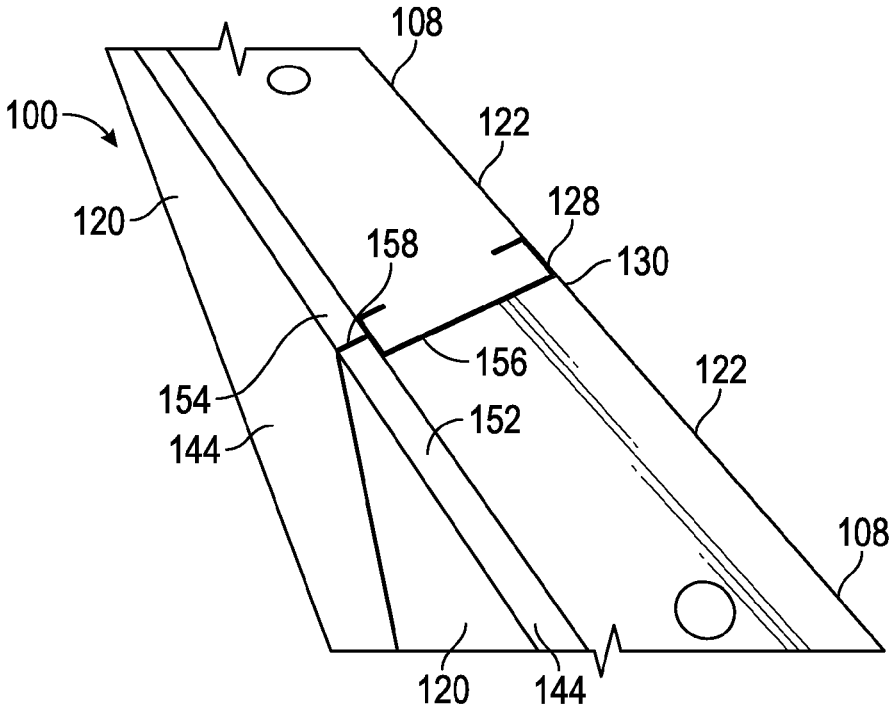
FIG. 8 is a top perspective view of two wall panels coupled together.
Figure 9:
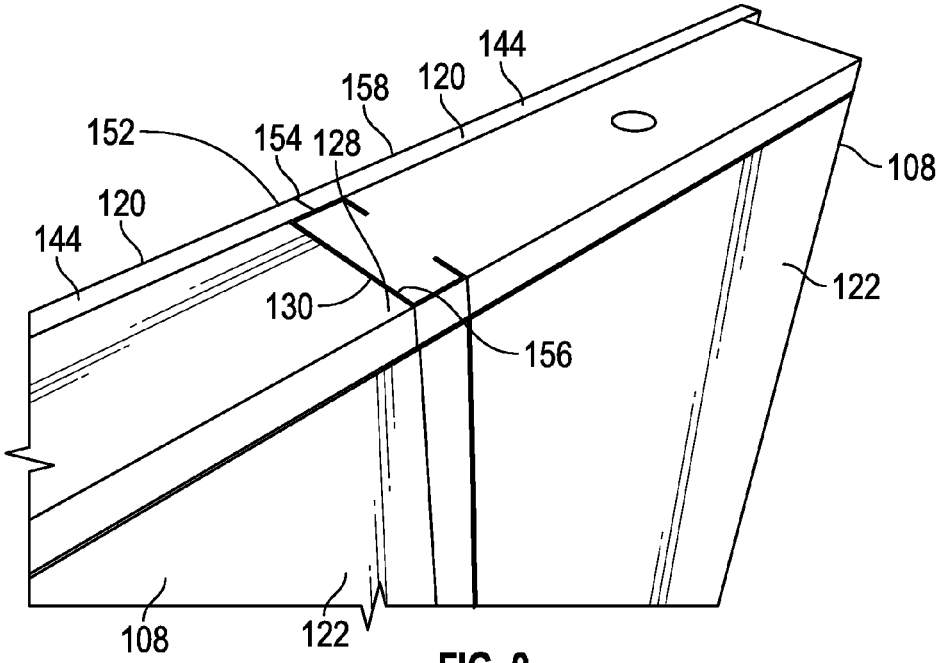
FIG. 9 is a rear perspective view of the two wall panels of FIG. 8.

Referring now to FIGS. 6 and 7, the top plate 116 can be received within the plate recess 148 on the interior side 122 of the wall panels 108 and within the extension recess 146 (not shown) on the exterior side 120 of the wall panels 108. For example, the sole plate 114 can be positioned to serve as track or guide for the positioning of the wall panels 108 (e.g., on the slab 106, on the floor panels 110, etc.). Once the sole plate 114 is positioned, the wall panels 108 can be laterally moved along a length of the sole plate 114 into a final position. In particular, a first wall panel 108 can be moved to a first end of the sole plate 114 such that the support member 126 of the first wall panel 108 (i.e., at the first lateral side 128) is immediately adjacent to the first end of the sole plate 114. Thereafter, a second wall panel 108 can be placed congruent or flush with the first wall panel 108 such that the second lateral side 130 of the first wall panel 108 is in contact with the first lateral side 128 of the second wall panel 108. In some embodiments, a coupling agent, such as an adhesive, can be placed between adjacent wall panels 108 to ensure that the wall panels 108 remain coupled together during the assembly process. The aforementioned process is repeated until a sufficient number of wall panels 108 are present to form the desired constituent (e.g., a wall) of the structure. After positioning of the top plate 116, the sole plate 114, and the wall panels 108, these elements can be further coupled together using one or more coupling techniques such as the application of adhesives or coupling devices that are disposed through the top plate 116 and/or the sole plate 114 and into some portions of the wall panels 108 (e.g., the structure members 126).

Before or after a desired number of wall panels 108 are present, the top plate 116 can be positioned using the extension recess 146 (not shown) and the plate recess 148 as guides or a track. After being positioned, the top plate 116 further functions to retain the wall panels 108 in place to preserve structural integrity of the structure. Moreover, in some aspects, after the top plate 116 is in position, an outside edge of the top plate 116 can be generally congruent or flush with the interior side 122 of the wall panels 108. As a result, the wall panels 108 can be finished at a later time without concern for the top plate 116 extending past the interior side 122 of the wall panels 108. In addition, the top plate 116 can define one or more plate apertures 150 that, when the top plate 116 is properly positioned, substantially or completely align with the vertical chases 140 (not shown in FIG. 7). Moreover, the sole plate 114 may also define one or more apertures to align with the vertical chases (not shown).

As illustrated in FIGS. 4, 5, 8, and 9, the extension members 144 on the wall panels 108 provide an additional point of engagement during assembly of the structure. Specifically, the extension members 144 can be coupled to some or all of the exterior sides 120 of the wall panels 108 such that extension members 144 on immediately adjacent wall panels 108 are capable of engaging each other. For example, the extension members 144 can be fabricated to exhibit substantially the same width as the wall panels 108; however, the extension members 144 can be coupled to the exterior side 120 such that a portion of the extension members 144 extends past the second lateral side 130. As a result, the extension members 144 define a flange 152 that extends from the second lateral side 130 of the wall panels 108 and a receiving recess 154 adjacent to the first lateral side 128. Accordingly, when the wall panels 108 are coupled together as described above and illustrated in FIGS. 8 and 9, the flange 152 of a first wall panel 108 is disposed within the receiving recess 154 of the adjacent wall panel 108 in a male-female connection.

As a result of the connection between the flange 152 and the receiving recess 154 of the extension members 144, a first seam 156 and a second seam 158 exist with respect to any two immediately adjacent wall panels 108. In particular, the first seam 156 is generally considered the interface of the first lateral side 128 of one wall panel 108 engaging with the second lateral side 130 of another wall panel 108. In addition, the second seam 158 can be generally considered the interface of the flange 152 of the extension member 144 from the first wall panel 108 engaging the receiving recess 154 of the extension member 144 of the second wall panel 108. Moreover, the first and second seams 156, 158 are generally not aligned, non-congruent, and/or incongruous. As such, this configuration of the unaligned first and second seams 156, 158 provides an additional layer of insulation because air and sound flow are unable to directly penetrate through the unaligned first and second seams 156, 158.

Figure 32:
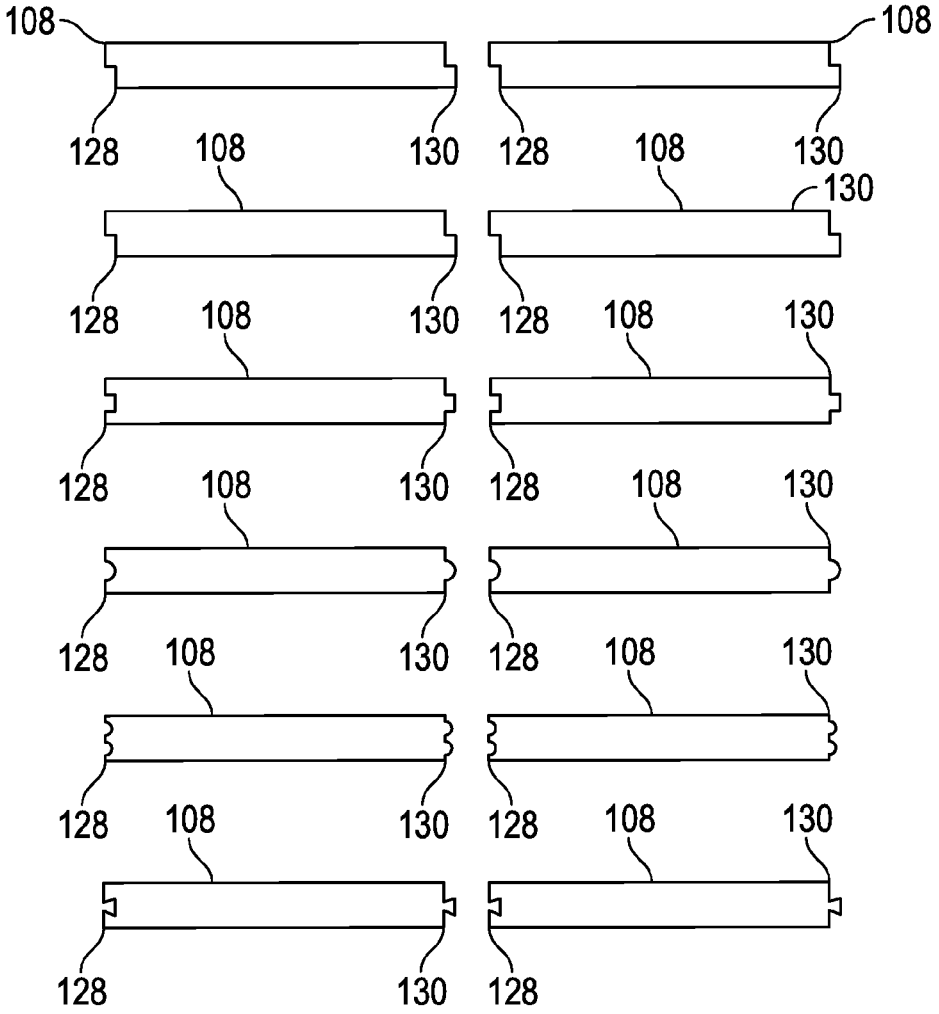
FIG. 32 is a series of top views of shiplap-configured wall panels.

The aforementioned connection between the flange 152 and the receiving recess 154 is commonly known as a "shiplapped" connection. Although the previously discussed shiplapped connection is considered exemplary, additional exemplary, but non-limiting examples of other shiplapped connections are illustrated in FIG. 32. In particular, these shiplapped connections can be used to engage the extension members 144 of adjacent wall panels 108 or the first and second lateral sides 128, 130 of lateral sides. As previously mentioned, regardless of configuration, the shiplap-configured connections can be coupled together using any conventional manner of coupling, including the use of adhesives and coupling members.

Figure 12:
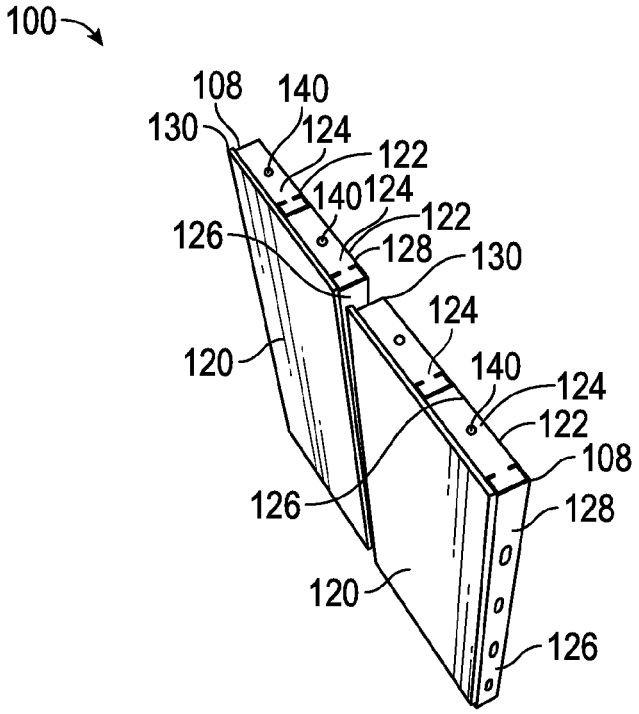
FIG. 12 is a top perspective view of an embodiment of two wall panels.
Figure 13:
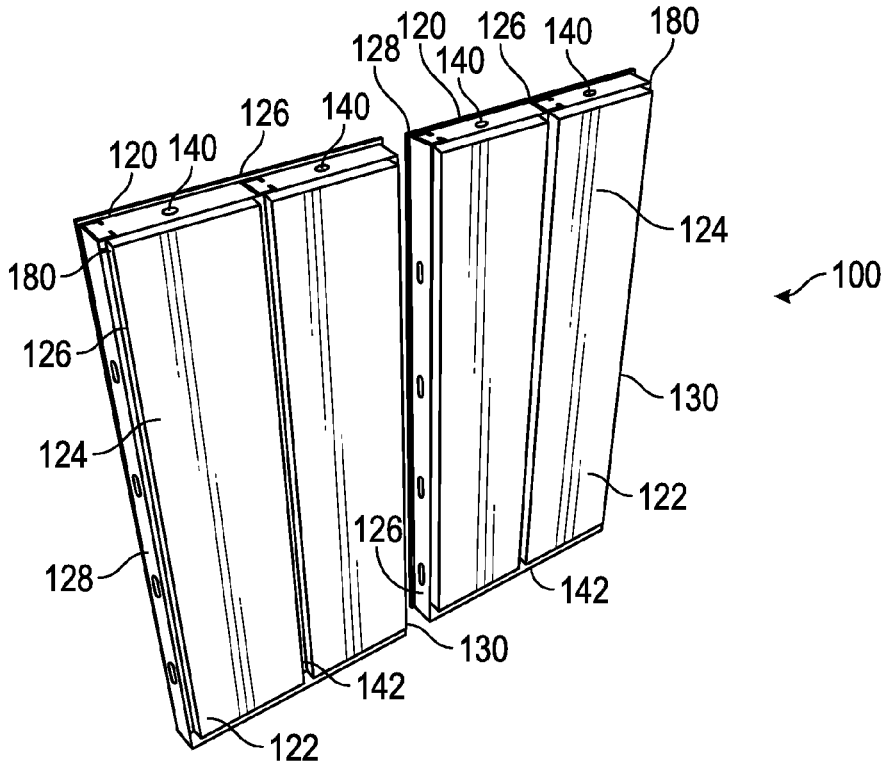
FIG. 13 is a rear perspective view of the two wall panels of FIG. 12.

Next, as shown in FIGS. 12 and 13, the wall panels 108 can be provided in different sizes. For example, some wall panels 108 can be manufactured as four-foot wide wall panels 108. In particular, at least some of the four-foot wide panels 108 exhibit a substantially similar configuration to the two-foot wide panels 108 (as shown in FIGS. 2-11). Specifically, the four-foot wide panels 108 may include the interior and exterior sides 120, 122, first and second lateral sides 128, 130, the insulation member 124, the support member 126 with gasket tape 142 (not shown in FIG. 12), the extension member 144, the vertical chases 140, the plurality of horizontal chases (not shown), and other similar features. In some aspects, the four-foot wide wall panels 108 can be generally configured as two two-foot wide wall panels 108 that have already been coupled together. Moreover, the four-foot wide wall panels 108 can be similarly assembled. For example, to provide the walls for a larger structure (e.g., a warehouse), wall panels 108 that are manufactured with greater widths can result in less assembly required onsite, which leads to more efficient structure construction.

Although the Figures referenced in the following discussion use the four-foot wall panels 108 to illustrate some additional aspects of the construction system 100, these additional aspects are not limited to the four-foot wall panels 108 and can be applied to other embodiments of the construction system 100, including the two-foot wide wall panels 108.

Figure 14:
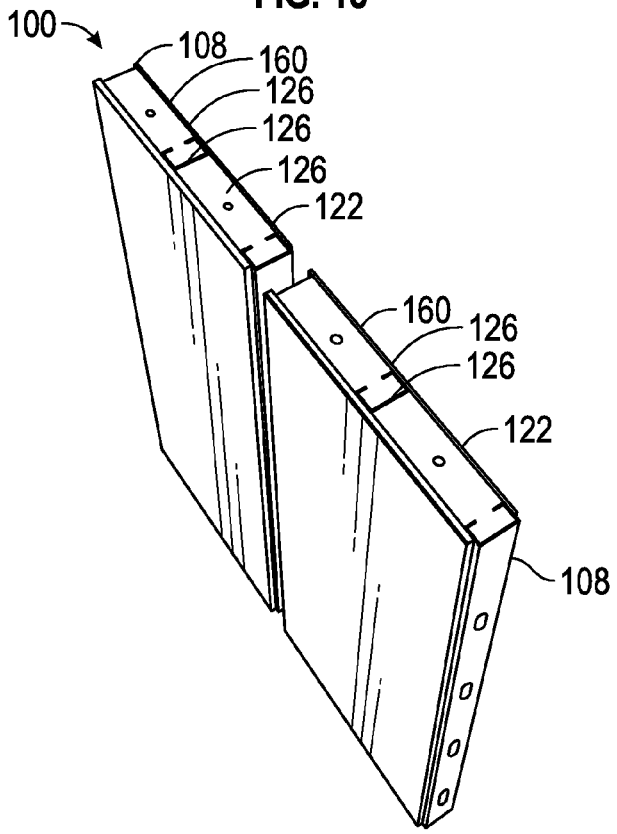
FIG. 14 is a top perspective view of an embodiment of two wall panels.
Figure 15:
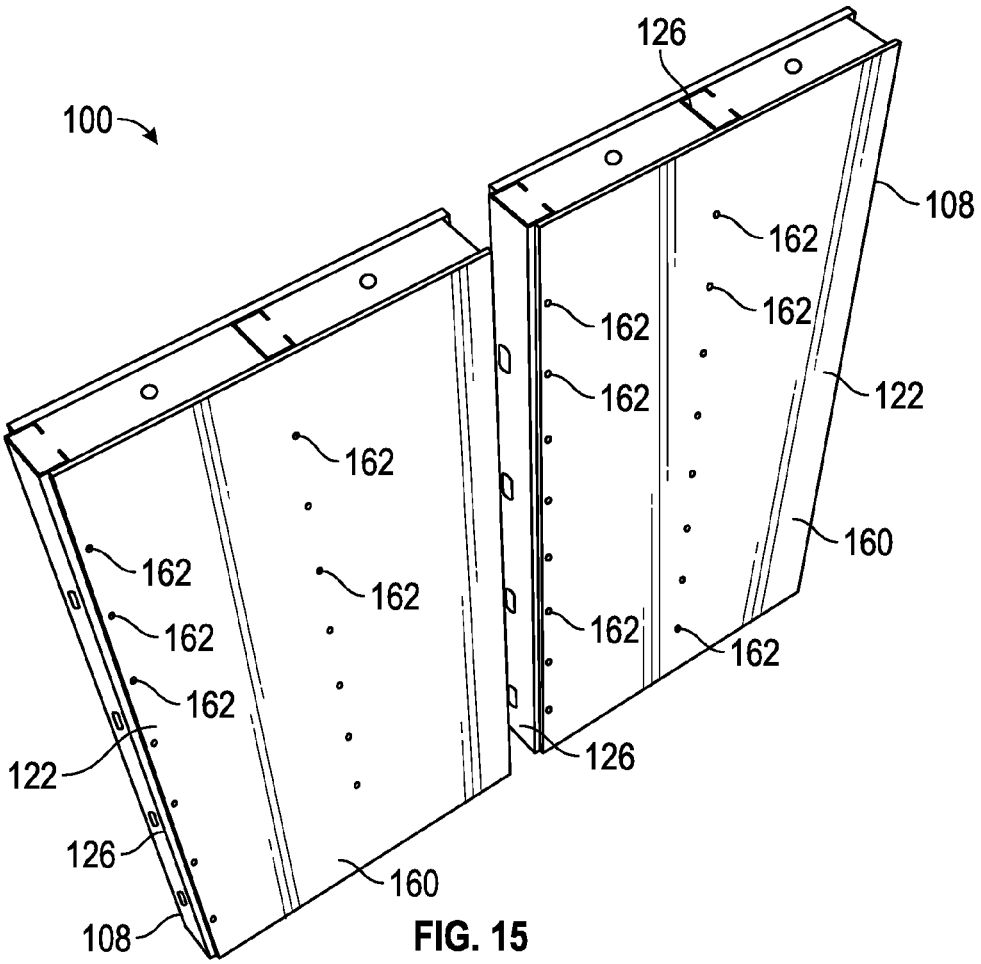
FIG. 15 is a rear perspective view of the two wall panels of FIG. 14.

As previously mentioned, some or all of the wall panels 108 can be manufactured in different configurations to meet the needs of the individuals employing the construction system 100. In some embodiments, the wall panels 108 can include an interior sheath 160, as shown in FIGS. 14 and 15. In particular, the interior sheath 160 can be coupled to the interior side 122 of the wall panels 108 before, after, or during manufacture of the wall panels 108. For example, the interior sheath 160 can be reversibly or irreversibly coupled to the support members 126. In particular, one or more coupling members 162 (not shown in FIG. 14) can be used to engage the interior sheath 160 to the support members 126. By way of example only, an automatic or semi-automatic process (e.g., using a pneumatic nail or screw gun) can be used to drive the coupling members 162 through the interior sheath 160 and the support members 126. Moreover, in some embodiments, the wall panels 108 can be provided without any type of sheathing (as shown in FIGS. 2-13) and sheathing can be affixed to the wall panels 108 after or during assembly of the structure. For example, in some embodiments, during fabrication of the wall panels 108, the wall panel 108 can be placed in an assembly machine (e.g., a jig) with the internal sheath 160 to ensure that the internal sheath 162 and the wall panel 108 are properly positioned and remain retained in that position. Thereafter, the internal sheath 160 can be coupled to the wall panel 108 (e.g., via coupling members 162 disposed through the internal sheath 162 and the support members 126).

Figure 17:
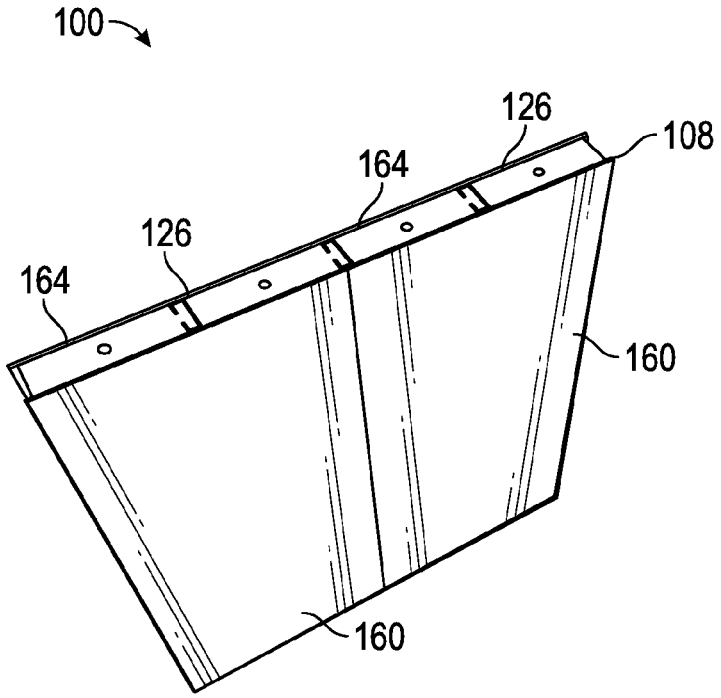
FIG. 17 is a rear perspective of the two wall panels of FIG. 16 after the two wall panels have been coupled together.

Referring now to FIGS. 16 and 17, some or all of the wall panels 108 can include an exterior sheath 164 in addition to, or in lieu of the interior sheath 160. In some aspects, the interior and exterior sheaths 160, 164 can be substantially or completely similar in nature and manner in which these elements are coupled to the wall panels 108. As such, the wall panels 108 can be provided with no sheathing, an interior sheath 160, an exterior sheath 164, and/or a combination of interior and exterior sheaths 160, 164.

In some aspects, the interior sheath 160 and/or the exterior sheath 164 can provide additional insulation and structural support for the structure. For example, the interior and/or exterior sheaths 160, 164 can be fabricated from magnesium oxide, DUROCK®, Forticrete®, fiber cement, STRUCTO-CRETE®, carbon fiber, poly-aramid fibers (e.g., Kevlar®), Plycem®, corrugated metal, metal cladding, fiberglass mesh, or other conventional materials that are capable of providing insulation and structural support. In particular, the interior and/or exterior sheaths 160, 164 can provide substantial compressive and tensile strength such that finishing elements within the structure (e.g., cabinets, shelving, awnings, etc.) can be affixed to the interior or exterior sheaths 160, 164. Moreover, when coupling together the individual wall panels 108, an elastomeric compound (e.g., caulk or other filler material) can be used to couple together interior and/or exterior sheaths 160, 164 from adjacent wall panels 108. Thereafter, the interior and/or exterior sheaths 160, 164 can be painted or otherwise finished (e.g., covered with stucco).

Figure 18:
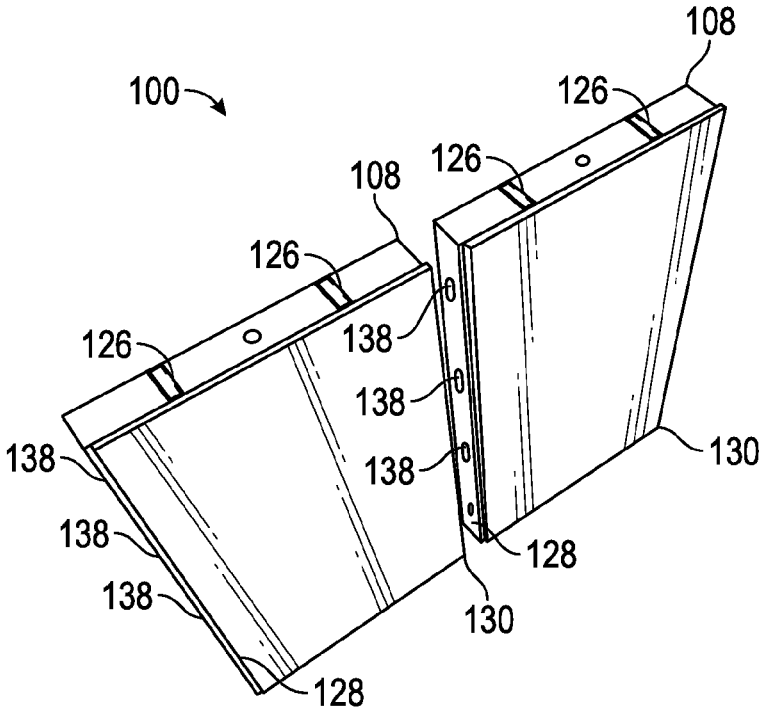
FIG. 18 is a rear perspective view of an embodiment of two wall panels.
Figure 19:
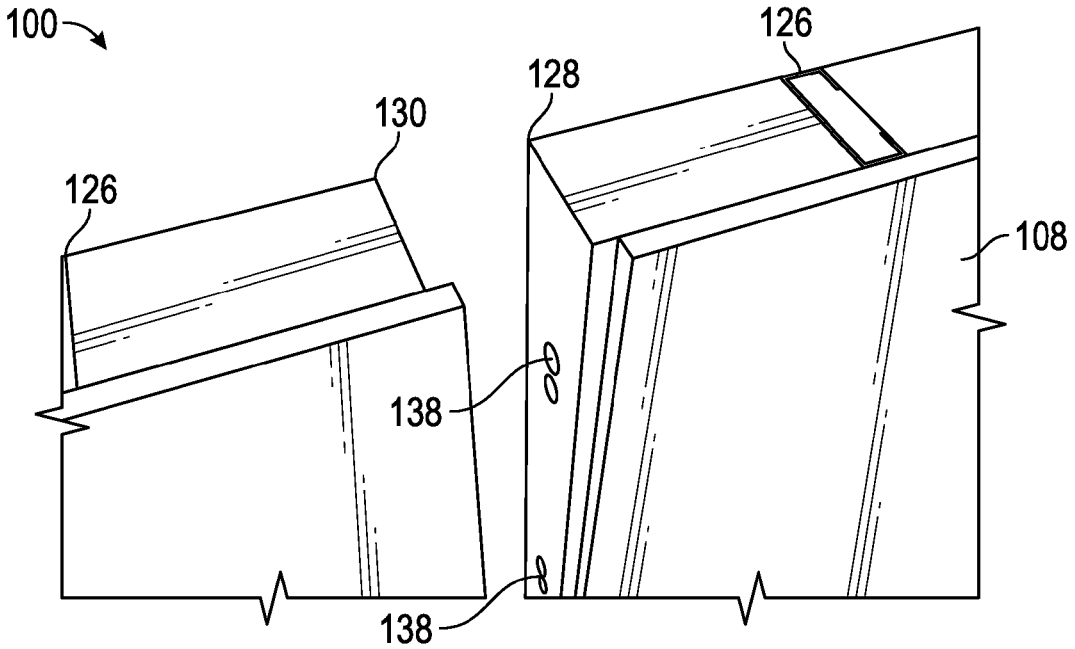
FIG. 19 is a magnified rear perspective view of the two wall panels of FIG. 18.

FIGS. 16, 18, and 19 illustrate alternative configurations of the positioning of the support member 126. As previously mentioned, in some embodiments, the support members 126 can be positioned at the first and/or the second lateral sides 128, 130 of the wall panels 108. In other embodiments, the support members 126 can be positioned at other positions within each of the wall panels 108. For example, within at least some four-foot wall panels 108, the support members 126 can be positioned approximately one foot inward from the first and second lateral sides 128, 130. As a result, when the wall panels 108 with this configuration of assembled to form the structure, the support members 126 are still approximately two feet apart to provide structural stability to the structure. In addition, although not illustrated in FIGS. 18 and 19, the support members 126 still include the apertures 136 to provide spacing for the horizontal chases 138. Overall, the positioning of the support members 126 can be at least partially correlated with the type of structure and needs of the manufacturer, assembler, and/or end user.

Moreover, FIG. 16 further illustrates the capacity of the wall panel 108 to adjust sizes. For example, if the individual assembling the structure requires a wall panel 108 of a lesser width than the wall panels 108 provided, the support member 126 can be removed and portions of the wall panel 108 (e.g., the insulation member 124) can be cut to remove any excess width and then the support member 126 can be repositioned at the first or second lateral side 128, 120.

Figure 20:
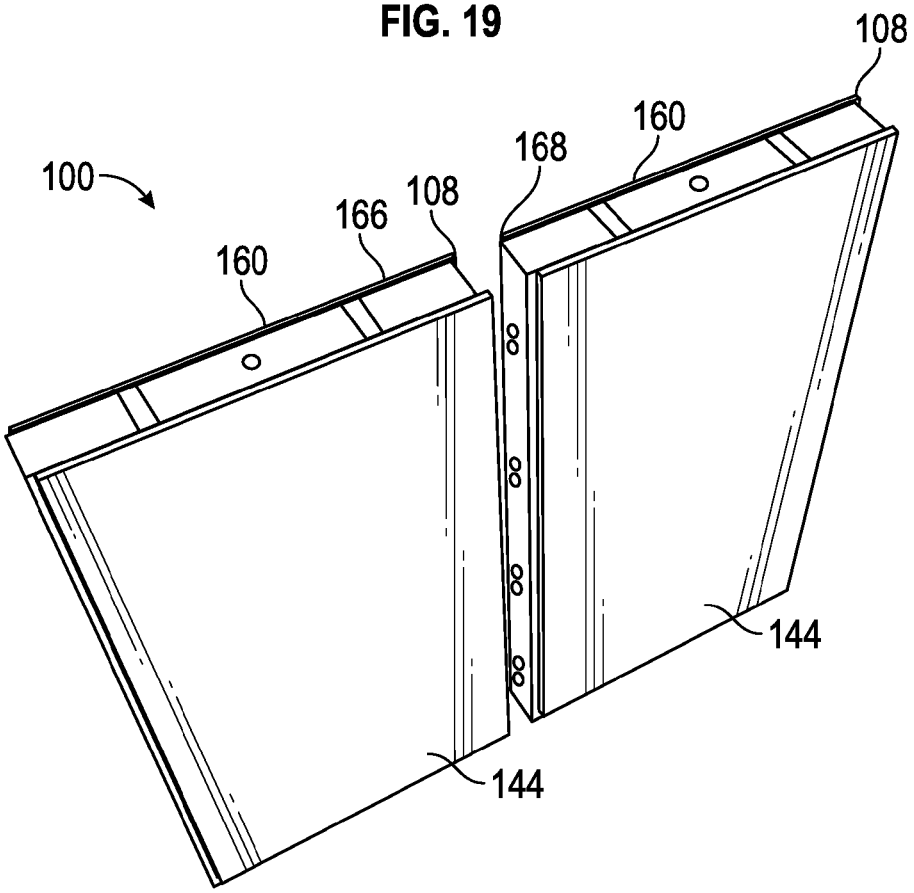
FIG. 20 is a rear perspective view of an embodiment of two wall panels.
Figure 21:
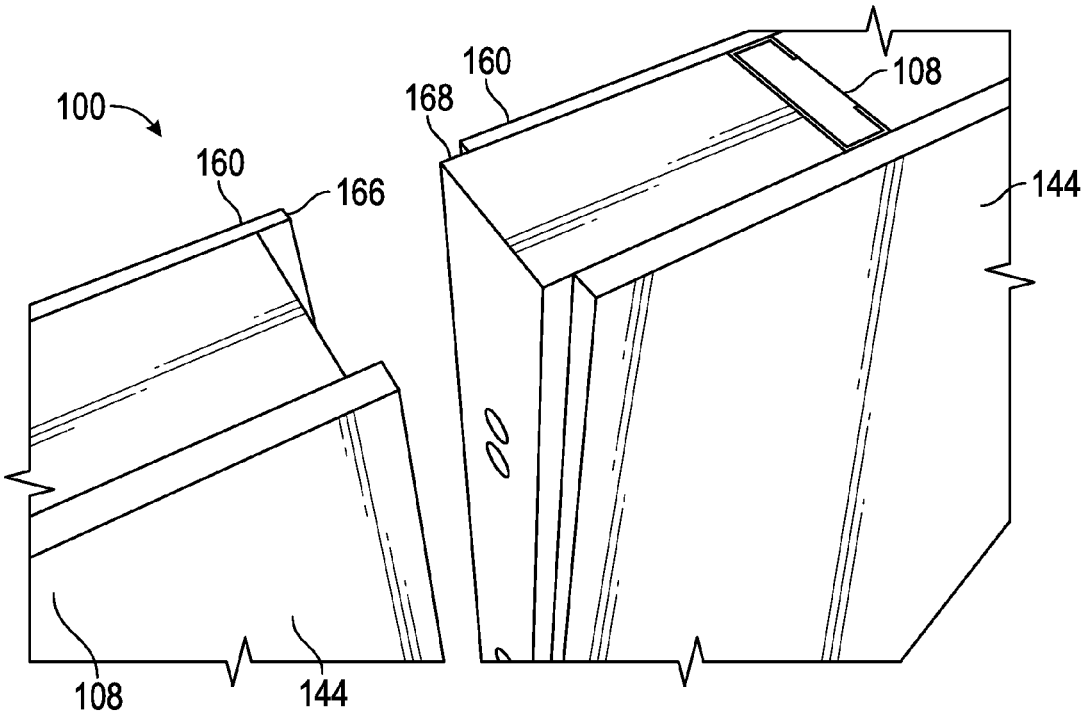
FIG. 21 is a magnified rear perspective view of the two wall panels of FIG. 20.

FIGS. 20 and 21 further illustrate that at least some of the wall panels 108 can include shiplap-configured internal sheaths 160 to complement the shiplap-configured extension member 144. In particular, the wall panel 108 can similarly include an interior sheath flange 166 and an interior sheath receiving recess 168 that can be engaged together to provide a third seam (not shown) for further insulation of the structure.

Figure 22:
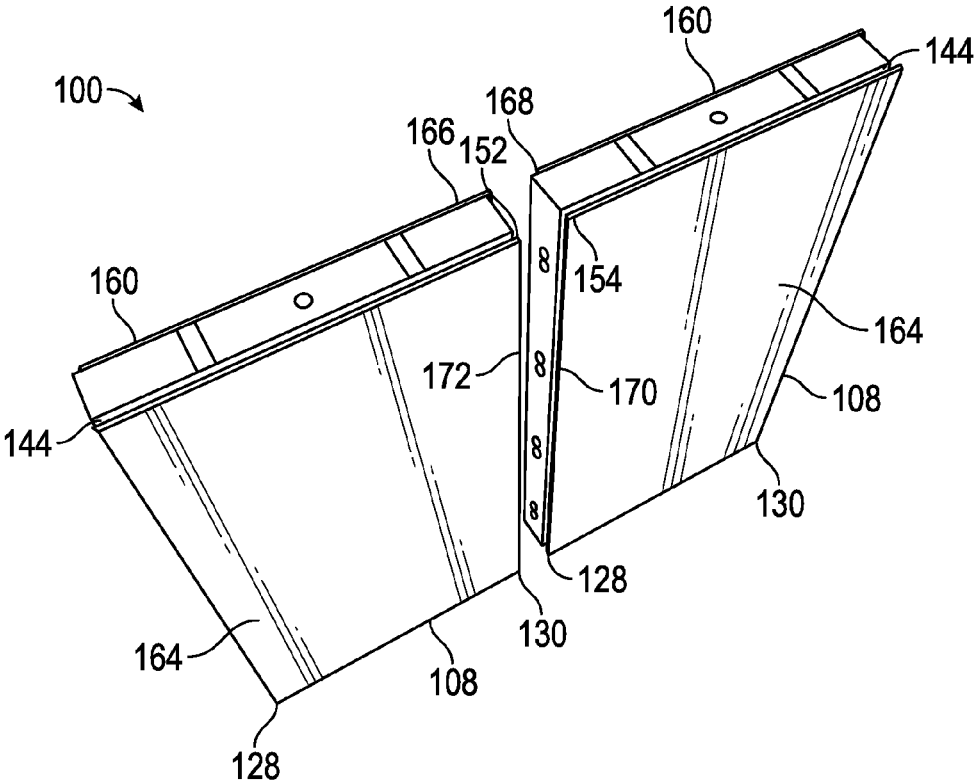
FIG. 22 is a rear perspective view of an embodiment of two wall panels.
Figure 23:
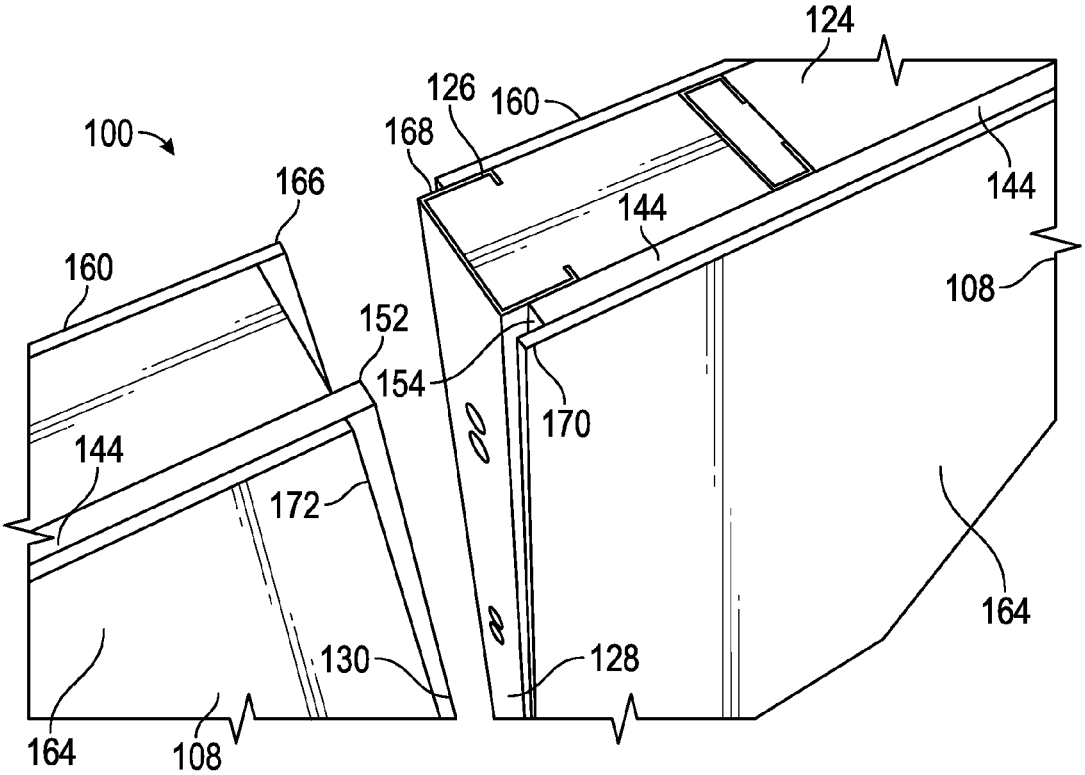
FIG. 23 is a magnified rear perspective view of the two wall panels of FIG. 22.

Next, FIGS. 22 and 23 illustrate another alternative configuration of the wall panels 108. In particular, the wall panels 108 can include shiplap-configured interior and exterior sheaths 160, 164 to complement the shiplap-configured extension members 144. Specifically, the exterior sheath 164 can be coupled to the extension members 144 of the wall panels 108 to provide an additional layer of insulation. Moreover, the extension members 144 and the interior and exterior sheaths 160, 164 can be substantially staggered to provide a plurality of seams to further enhance the insulation of the structure. For example, the interior sheath flange 166 and the extension flange 152 can extend from a first wall panel 108 at the second lateral side 130 and an exterior sheath flange 170 can extend from a second wall panel 108 at the first lateral side 128. As such, the interior sheath flange 166 and the extension flange 152 can engage the interior sheath receiving recess 168 and the extension receiving recess 154 at the first lateral side 128 of the second wall panel 108 and the exterior sheath flange 170 can engage an exterior sheath receiving recess 172 on the second lateral side of the first wall panel 108. Together, these engagements can provide for four substantially unaligned seams (not shown) to provide significant insulation for the structure.

Figure 24:
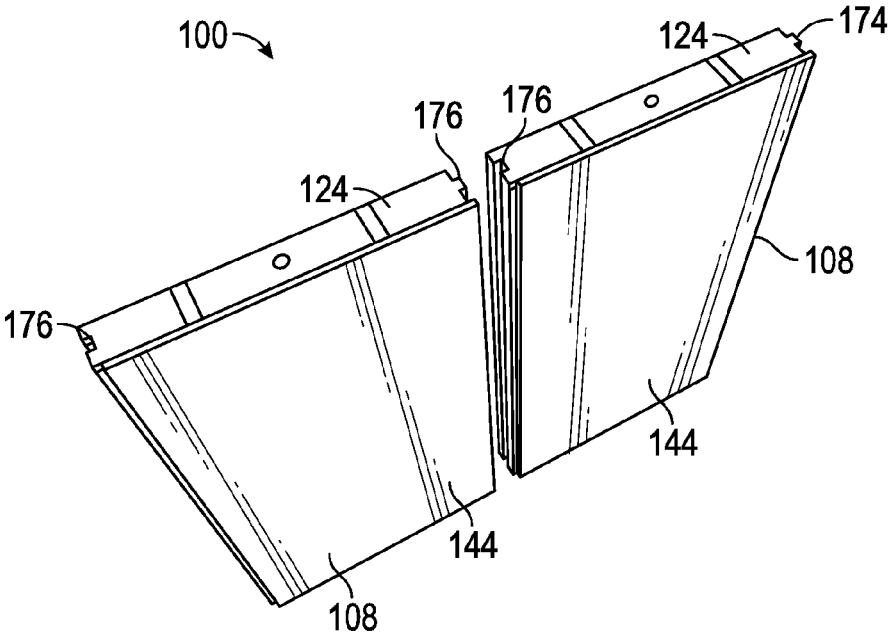
FIG. 24 is a rear perspective view of an embodiment of two wall panels.
Figure 25:
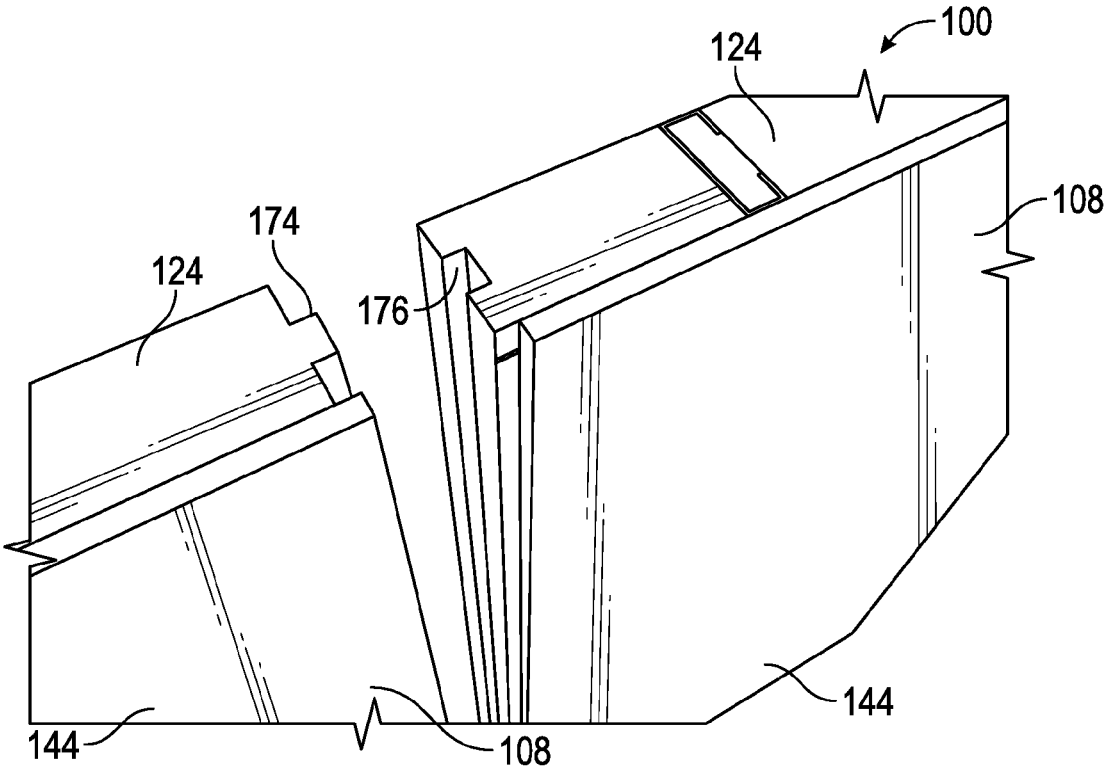
FIG. 25 is a magnified rear perspective view of the two wall panels of FIG. 24.

FIGS. 24 and 25 illustrate another configuration of the wall panels 108. In particular, the insulation members 124 can include a similar configuration to the extension members 144 and/or the interior and exterior sheaths 160, 164 described above. For example, the insulation member 124 can include an insulation flange 174 and an insulation recess 176 such that the insulation flange 174 on a first wall panel 108 can engage the insulation recess 176 defined by a second wall panel 108 to provide an additional seam for further insulation of the structure.

Figure 26:
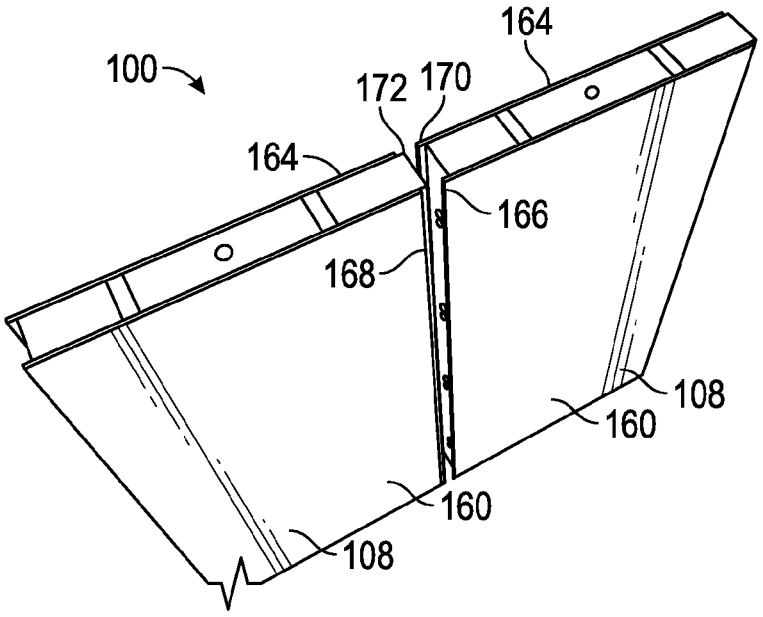
FIG. 26 is a rear perspective view of an embodiment of two wall panels.
Figure 27:
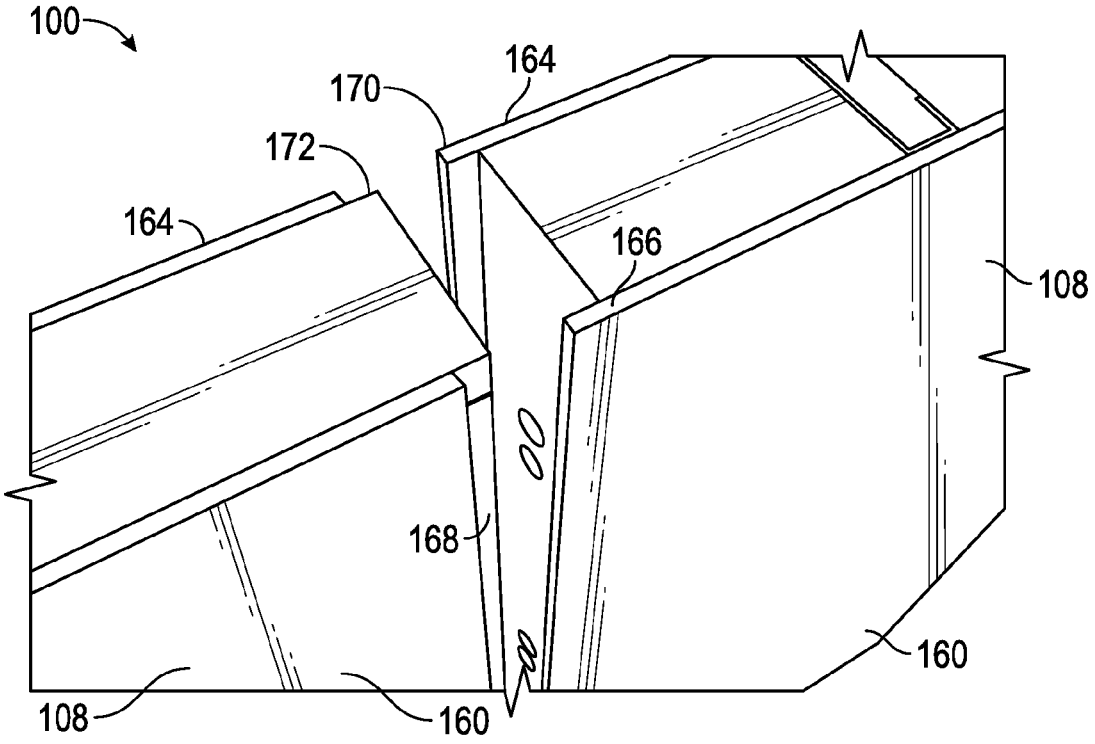
FIG. 27 is a magnified rear perspective view of the two wall panels of FIG. 26.

Referring now to FIGS. 26 and 27, the wall panels 108 can exhibit an alternative configuration that functions without the extension members 144. For example, the internal and external sheaths 160, 164 can be configured with internal and external sheath flanges 166, 170 and internal and external sheath receiving recesses 168, 172 to provide the additional seams (not shown) without the use of the extension member 144.

Figure 33:
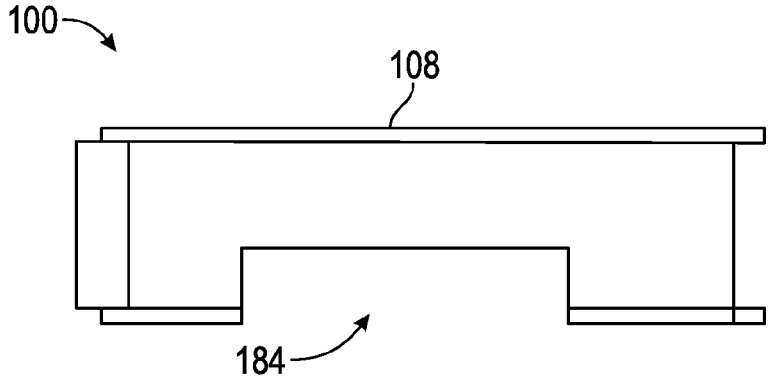
FIG. 33 is a top view of a wall panel with a cavity.

Referring now to FIG. 33, some wall panels 108 may exhibit an alternative configuration. For example, one or more wall panels 108 can include a cavity 184 that is configured and arranged to function as an integrated utility wall within the finalized structure. In particular, the cavity 184 can be configured as an area of reduced depth relative to the remainder of the particular wall panel 108 such that plumbing waste, vents, and other utility-related apparatuses (e.g., a breaker or fuse box) can be positioned within the cavity 184. Moreover, the utility conduits defined by the horizontal and vertical chases 138, 140 (not shown) can generally guide the particular utility streams to the cavity 184. In regards to other elements of the wall panel 108 that includes the cavity 184, many of the elements can remain substantially or completely similar to other wall panels 108 described above.

Figure 28:
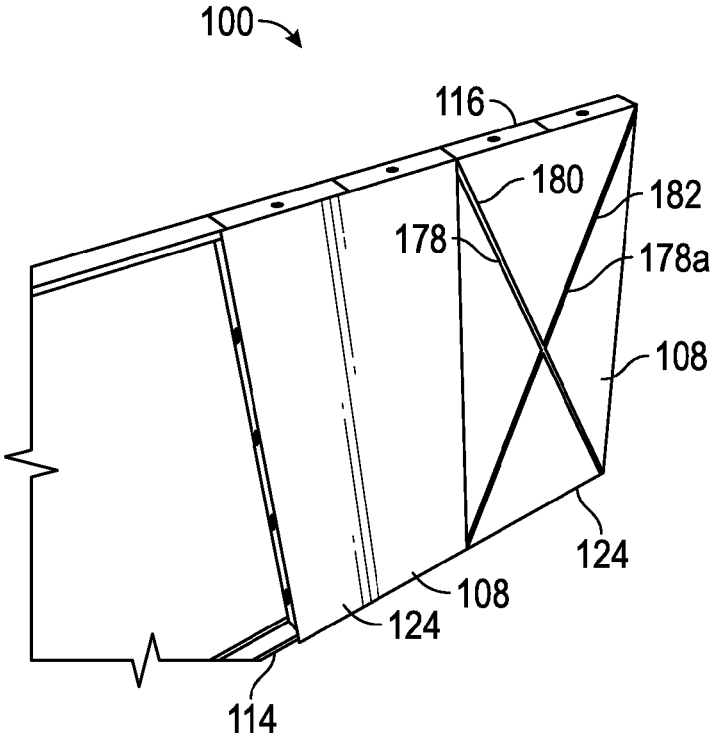
FIG. 28 is a rear perspective of an embodiment of a wall panel with a first and a second reinforcement member.
Figure 29:
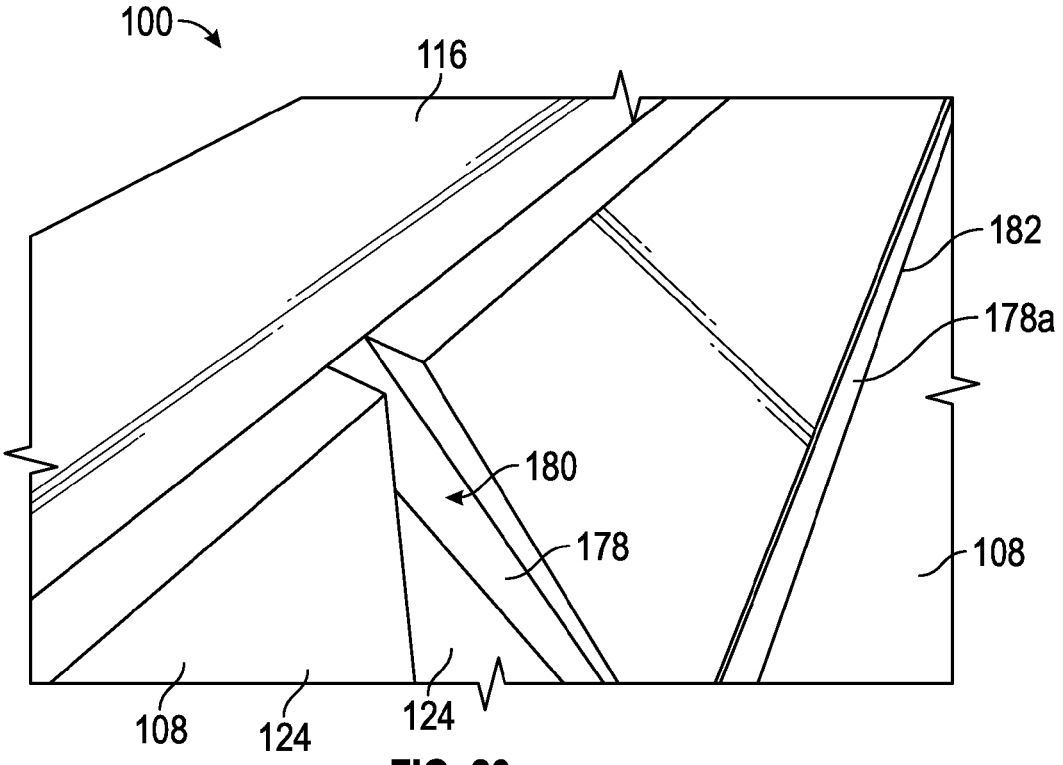
FIG. 29 is a magnified perspective view of the wall panel of FIG. 28.

FIGS. 28 and 29 illustrate a manner in which an individual can reinforce the structural integrity of one or more wall panels 108. In particular, the individual can improve the amount of shear strength of some or all of the wall panels 108 (e.g., the ability to resist high-speed winds) by removing portions of the insulation member 124 and inserting at least one reinforcement member 178. For example, a first channel 180 and a second channel 182 can be positioned in an intersecting diagonal configuration (i.e., an "X" shape) by removing (e.g., cutting) portions of the insulation member 124. Thereafter, a first reinforcement member 178 can be placed in the first channel 180 and a second reinforcement member 178*a* can be placed in the second channel 182. As a result of the intersecting diagonal configuration of the first and second channels 180, 182, the first and second reinforcement members 178, 178*a* can also intersect in a generally medial portion of the wall panel 108 to provide additional structural support. After positioning, the first and second reinforcement members 178, 178*a* can be coupled to the top and sole plates 114, 116 (sole plate 114 not shown in FIG. 29) and/or the support members 126 (not shown) to ensure sufficient coupling.

Figure 34:
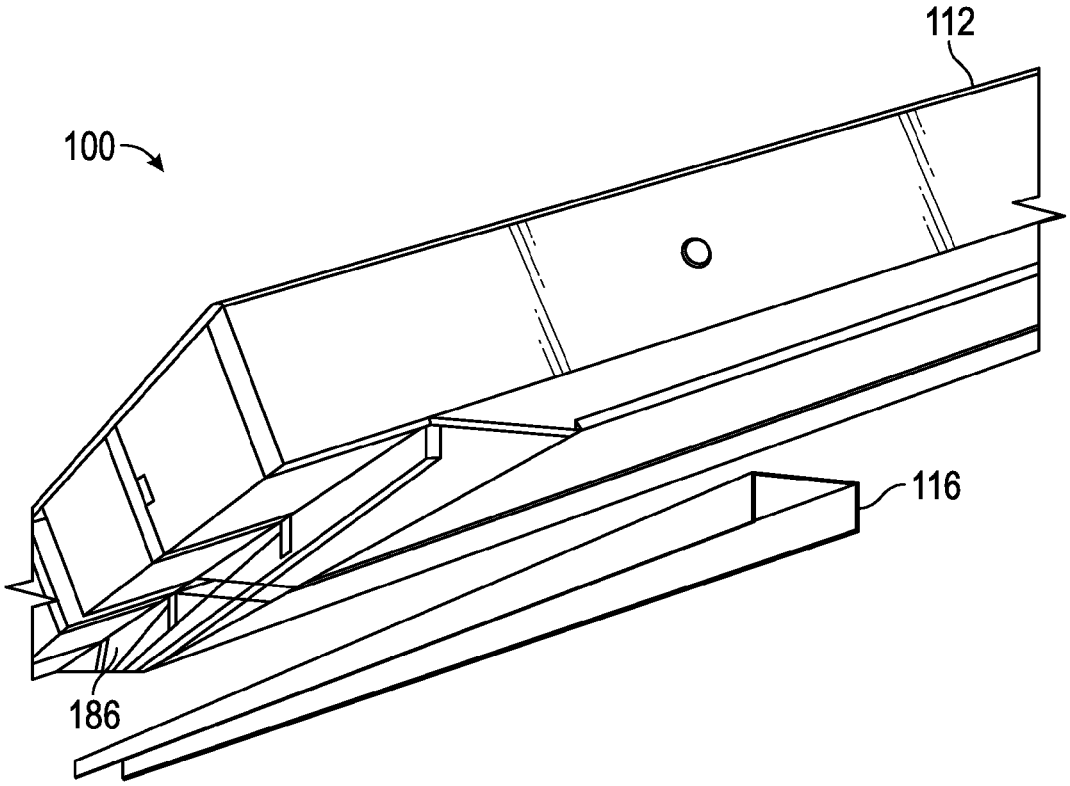
FIG. 34 is a side perspective view of roof panels and wall panels of the construction system of FIG. 1.
Figure 34:
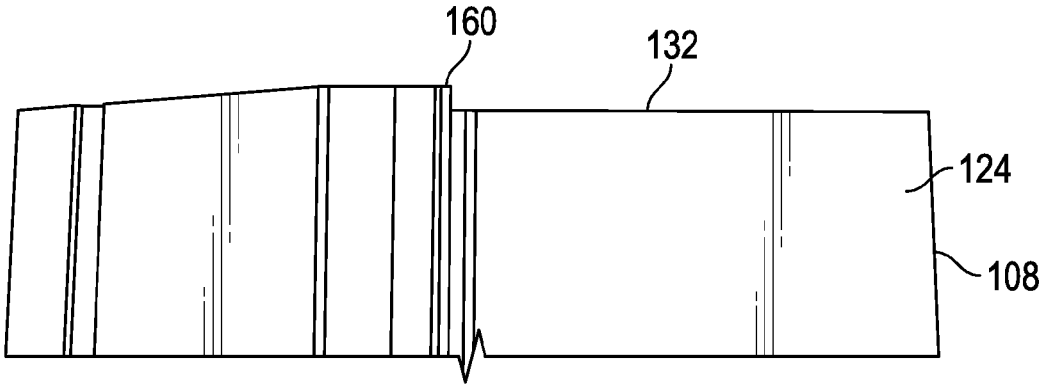
Figure 35:
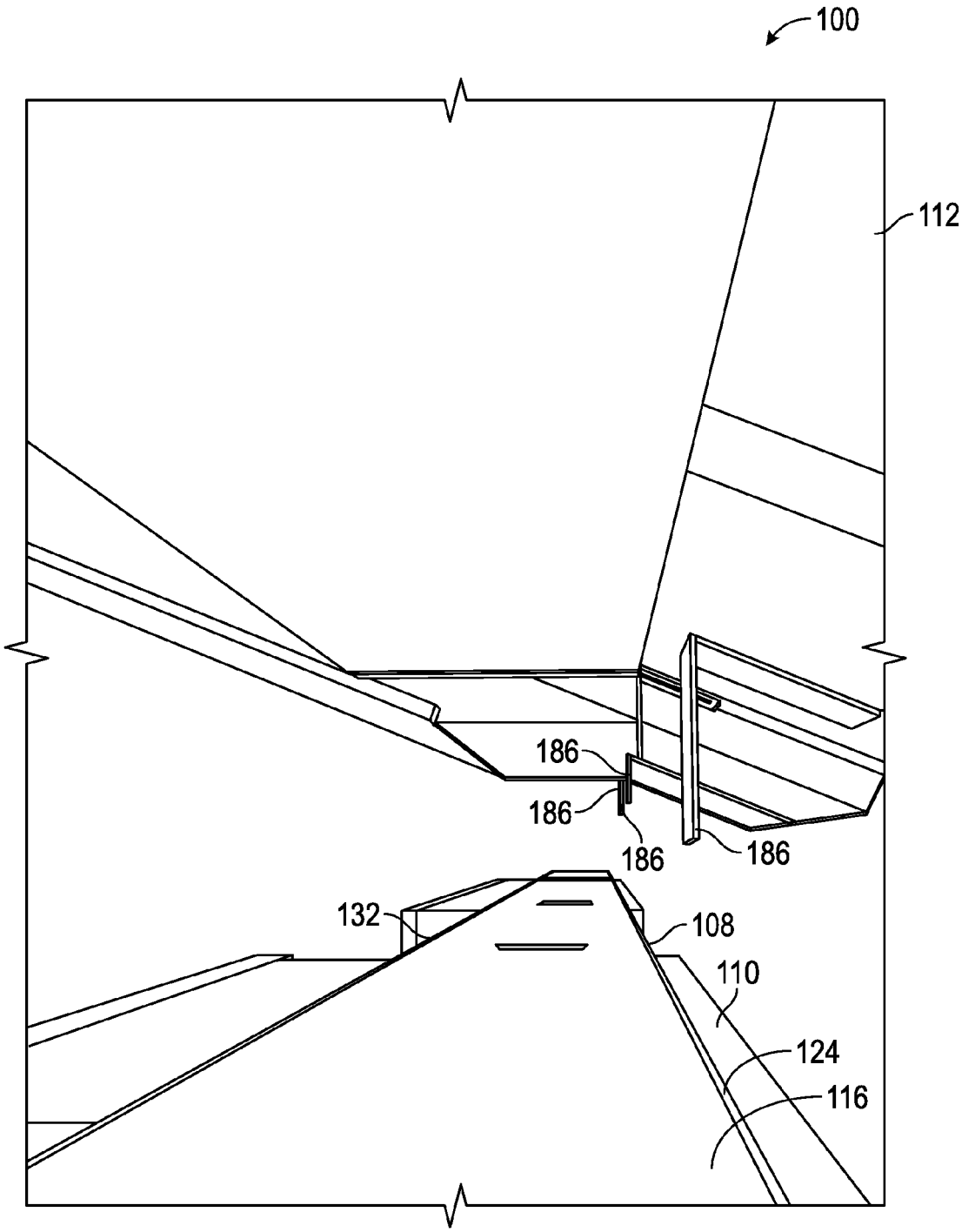
FIG. 35 is a side view of roof panels being coupled to wall panels using clips.

FIGS. 34 and 35 illustrate a manner in which one or more of the roof panels 112 can be coupled to the wall panels 108. For example, after coupling together of some or all of the wall panels 108, the top plate 116 can be coupled to the upper sides 132 of the wall panels 108. Thereafter, one or more clips 186 can be positioned between the interior sheath 160 and the insulation member 124 at a point immediately adjacent to each of the support members (not shown). Thereafter, a coupling member (not shown) can be disposed through the interior sheath 160, the clips 186, and the support member (not shown) to permanently couple together the clips 186 and the wall panels 108. The clips 186, which can be angled to suit the needs of the manufacturer or individuals assembling the structure, can be coupled to one or more structure members (not shown) disposed in the roof panels 112 to couple the wall panels 108 to the roof panels 112.

Figure 30:
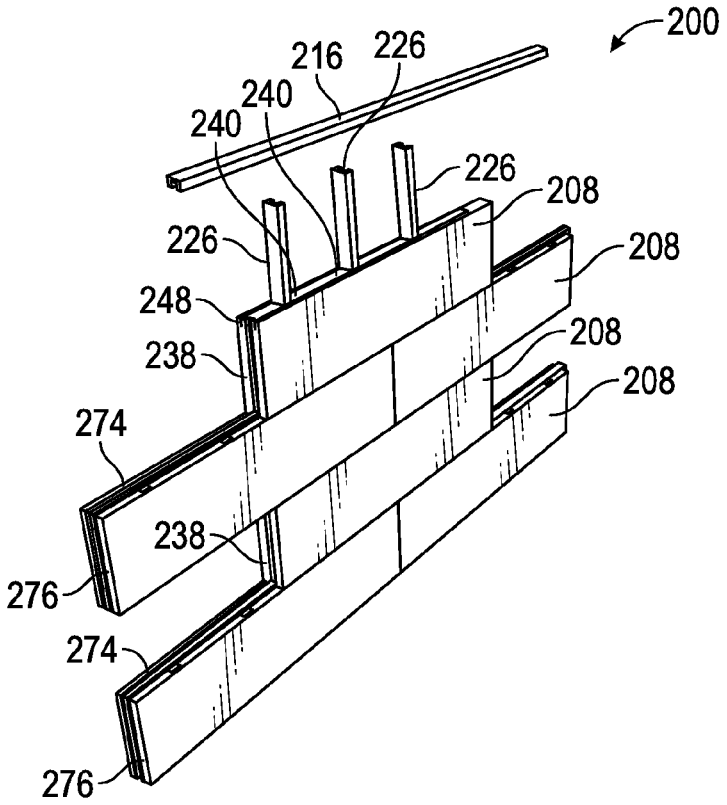
FIG. 30 is a perspective view of a second embodiment of the construction system.
Figure 31:
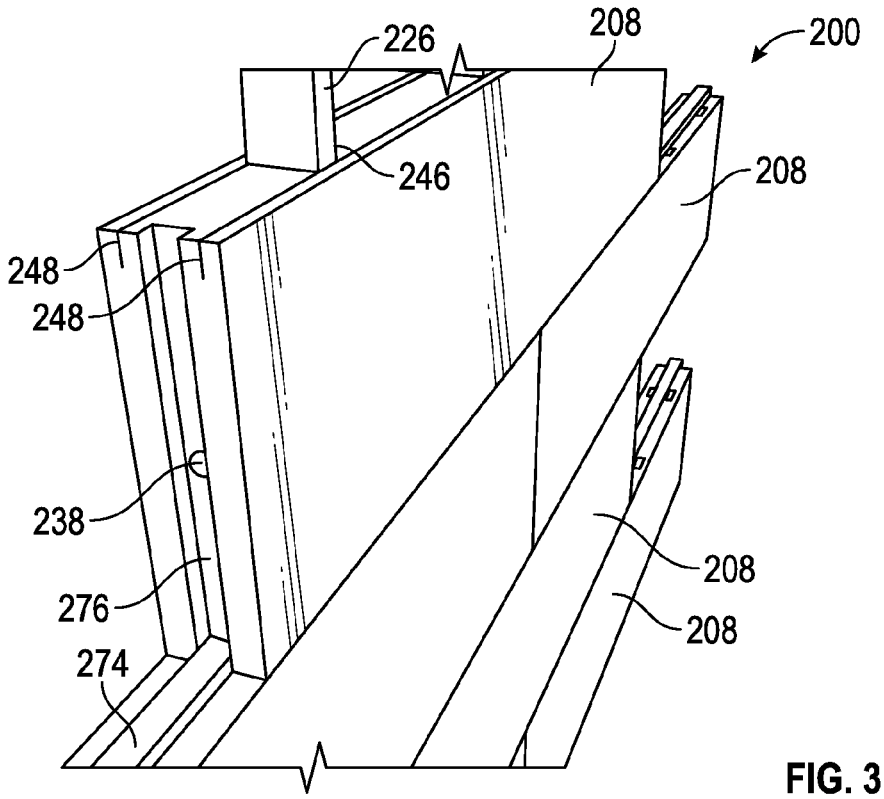
FIG. 31 is a magnified side perspective view of the second embodiment of the construction system of FIG. 30.

FIGS. 30 and 31 illustrate an alternative embodiment construction system, designated 200. In particular, the wall panels 208 can be horizontally arranged to provide the walls of the structure. For example, during construction a sole plate (not shown) can be secured to the structure under construction such that one or more structure members 226 can be coupled thereto. Moreover, the wall panels 208 can include vertical chases 240 that are configured and arranged to receive the support members 226. Thereafter, the wall panels 208 can be positioned over the support members 226 so that the wall panels 208 are vertically moved toward the sole plate to provide for a stacked configuration. Moreover, the wall panels 208 can include horizontal chases 238 such that, after assembly, the plurality of horizontal chases 238 can substantially or completely align to form the utility conduits. Moreover, the insulation members 224 of the wall panels 208 can also include the insulation flange 274 and the insulation recess 276 to provide a mechanism to guide laterally adjacent wall panels 208 together for alignment purposes. The insulation flange 274 and the insulation recess 276 also provide additional insulation in the form of an air break. Furthermore, at least one of the wall panels 208 configured to be positioned at the top of the stacked configuration may include one or more plate recesses 248 in order to receive the top plate 216 (not shown in FIG. 31). Although not described in detail for this embodiment, the construction system 200 can include any of the other previously described features for the construction system 100 that are compatible with a horizontal configuration (e.g., interior and/or exterior sheaths, extension members, etc.) (not shown).

Figure 36:
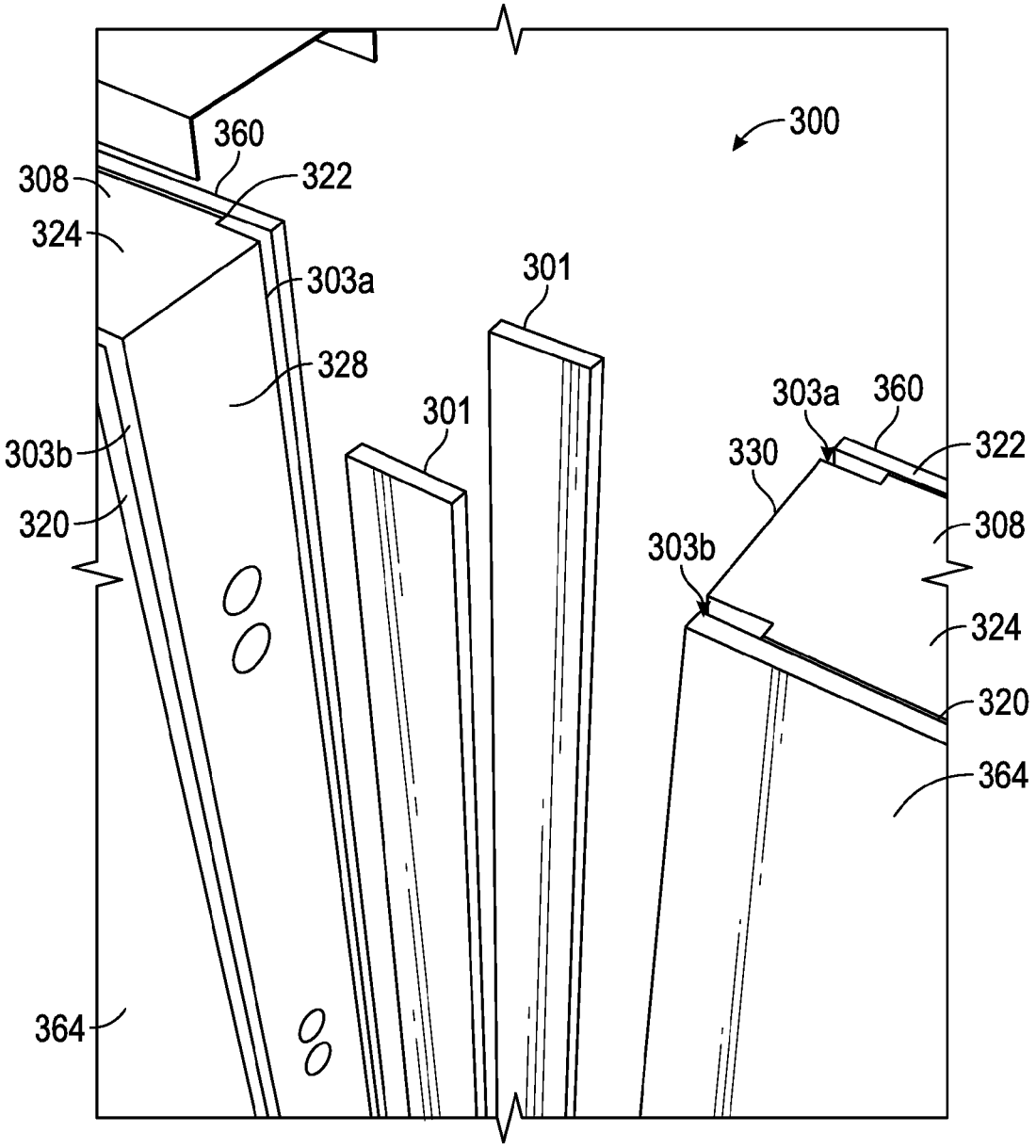
FIG. 36 is a perspective view of a third embodiment of the construction system.

FIG. 36 illustrates another embodiment of the construction system, designated 300. In some aspects, the construction system 300 can include one or more splines 301. Moreover, the construction system 300 can include the splines 301 to function to support the structure. For example, the wall panels 308 can include splines 301 in addition to or in lieu of the support members (not shown in FIG. 36). In particular, the splines 301 can be positioned at regular, repeating intervals (e.g., every two feet) so that splines 301 on multiple levels of the structure align to provide structural support. By way of example only, in some aspects, some or all of the splines 301 can be positioned at the interface between two wall panels 308. In other words, the splines 301 can be positioned generally adjacent to where the first lateral side 328 of a first wall panel 308 engages the second lateral side 330 of a second wall panel 308.

In some aspects, the wall panels 308 can be configured to engage the splines 301. For example, the wall panels 308 can include a first spline recess 303*a* defined between the interior sheath 360 and the interior side 322 of the wall panel 308 and a second spline recess 303*b* defined between the exterior sheath 364 and the exterior side 320 of the wall panels 308. As a result, when the first lateral side 328 of a first wall panel 308 engages the second lateral side 330 of a second wall panel 308 are adjacent to each other, the splines 301 can be positioned to be received within the first and second spline recesses 303*a*, 303*b* to ensure that the splines 301 remain secured during and after construction of the structure. In other embodiments, the first and second spline recesses 303*a*, 303*b* can be disposed within the insulation member 324 and/or between the insulation member 324 and the extension member (not shown in FIG. 36)

Overall, embodiments of the construction system 100, 200 can be employed to provide prefabricated construction materials for use in relatively quickly and efficiently assembling a structure, such as a dwelling. Moreover, because of the ready-to-use configurations detailed above, builders, construction workers, and others working to assemble the structure do not need significant experience and skill to use the construction system 100, 200. In addition, because of the multiple avenues of providing layers of insulation, including the multiple thermal breaks, sound breaks, and barriers to the transmission of water vapor (e.g., the insulation member 124, the interior and exterior sheaths 160, 164, and/or the extension member 144), the construction system 100, 200 can provide affordable construction materials that result in a desirable structure.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A wall panel comprising:

a first lateral side laterally opposing a second lateral side;

an upper side vertically opposing a lower side;

an insulation member comprising processed portions extending into lateral sides of the insulation member;

at least one metal support member coupled to a side surface of the insulation member to provide load bearing support, wherein the at least one metal support member comprises a substantially C-shaped configuration and the processed portions are configured to receive the C-shaped configuration, and wherein the at least one metal support member is insertable over the upper side of the wall panel within the processed portions of the insulation member to align with the side surface of the insulation member and the at least one metal support member is coupled to the insulation member such that the at least one metal support member extends along the side surface of the insulation member from a position immediately adjacent to the upper side of the wall panel to a position immediately adjacent to the lower side of the wall panel;

wherein an extension member portion of the insulation member provides an extension of the insulation member over an exterior side of the wall panel, and over the at least one metal support member;

an exterior sheath disposed over the extension member portion of the insulation member and over the exterior side of the wall panel and mechanically coupled or laminated to the at least one metal support member, and an interior sheath coupled to an interior side of the wall panel, the exterior and interior sheaths including magnesium oxide;

at least one horizontal chase defined through the insulation member and extending from the first lateral side to the second lateral side;

at least one vertical chase defined through the insulation member and extending from the upper side to the lower side; and wherein the extension of the insulation member provided by the extension member portion of the insulation member provides a barrier between the exterior sheath and the at least one metal support member, and a recess is disposed between the at least one metal support member and the exterior sheath adjacent the extension member portion of the insulation member.

2. The wall panel of claim 1, wherein the insulation member further includes an insulation member flange that extends from the second lateral side of the wall panel and an insulation member recess adjacent to the first lateral side of the wall panel.

3. The wall panel of claim 1, wherein the at least one metal support member is capable of being removed and coupled to another portion of the insulation member.

4. The wall panel of claim 1 further comprising a cavity.

5. The wall panel of claim 1 further comprising gasket tape coupled to at least a portion of the at least one metal support member facing the exterior sheath.

6. The wall panel of claim 1, wherein the extension member portion of the insulation member provides a one inch extension of the insulation member over the exterior side of the wall panel.

7. The wall panel of claim 1, further comprising a second metal support member disposed within a cavity of the insulation member between the first lateral side and second lateral side of the wall panel.

8. The wall panel of claim 1, wherein the interior sheath includes an interior sheath flange on a first side of the interior sheath and an opposing interior sheath recess on a second side of the interior sheath.

9. A pre-fabricated wall panel, comprising:

an insulation member comprising processed portions extending into lateral sides of the insulation member;

at least one metal support member coupled to a side surface of the insulation member, wherein the at least one metal support member comprises a substantially C-shaped configuration, wherein the at least one metal support member is insertable over an upper side of the wall panel within the processed portions of the insulation member such that ends of the metal support member extend into the lateral sides of the insulation member, and wherein an extension member portion of the insulation member provides an extension of the insulation member over an exterior side of the pre-fabricated wall panel; and an exterior sheath disposed over the extension member portion of the insulation member and over an exterior side of the pre-fabricated wall panel and an interior sheath disposed over an interior side of the pre-fabricated wall panel, the exterior and interior sheaths including magnesium oxide, wherein the extension member portion of the insulation member provides a barrier between the exterior sheath and the at least one metal support member.

10. The pre-fabricated wall panel of claim 9, wherein the exterior sheath is mechanically coupled or laminated to the at least one metal support member and the insulation member.

11. The pre-fabricated wall panel of claim 9, wherein the exterior sheath includes an exterior sheath flange and an exterior sheath recess for coupling the pre-fabricated wall panel to a separate adjacent wall panel.

12. The pre-fabricated wall panel of claim 9, further comprising a recess disposed between the at least one metal support member and the exterior sheath adjacent the extension member portion of the insulation member.

13. The pre-fabricated wall panel of claim 9, wherein a side edge of the extension member portion of the insulation member is offset from a side edge of the pre-fabricated wall panel and the at least one metal support member.

14. The pre-fabricated wall panel of claim 9, wherein a portion of the extension member portion of the insulation member extends beyond a lateral side of the pre-fabricated wall panel to define a flange.

15. The pre-fabricated wall panel of claim 9, wherein the insulation member and the extension member portion of the insulation member comprise a rigid foam.

* * * * *